US010969194B2

(12) United States Patent
Frank et al.

(10) Patent No.: US 10,969,194 B2
(45) Date of Patent: Apr. 6, 2021

(54) SPITBALL GUN FOR USE WITH PAPER AMMUNITION

(71) Applicant: JAKKS Pacific, Inc., Santa Monica, CA (US)

(72) Inventors: Gregory Frank, Los Angeles, CA (US); Vishaal Boehm Verma, Evanston, IL (US); Steve Rehkemper, Chicago, IL (US)

(73) Assignee: JAKKS Pacific, Inc., Santa Monica, CA (US)

( * ) Notice: Subject to any disclaimer, the term of this patent is extended or adjusted under 35 U.S.C. 154(b) by 0 days.

(21) Appl. No.: 16/806,868

(22) Filed: Mar. 2, 2020

(65) Prior Publication Data

US 2020/0217611 A1 Jul. 9, 2020

Related U.S. Application Data

(63) Continuation-in-part of application No. 15/927,924, filed on Mar. 21, 2018, now Pat. No. 10,578,393.
(Continued)

(51) Int. Cl.
*F41B 11/89* (2013.01)
*F41B 7/08* (2006.01)
(Continued)

(52) U.S. Cl.
CPC ..... *F41B 11/89* (2013.01); *F41B 7/08* (2013.01); *F41B 9/00* (2013.01); *F41B 11/50* (2013.01); *F41B 11/646* (2013.01)

(58) Field of Classification Search
CPC .. F41B 9/00; F41B 11/60; F41B 11/62; F41B 11/64; F41B 11/89; F42B 6/00; F42B 6/10; F42B 12/40; F42B 12/74
(Continued)

(56) References Cited

U.S. PATENT DOCUMENTS 4,565,183 A * 1/1986 Smith ..... F42B 12/40 124/26
4,843,751 A * 7/1989 Ferri ..... F41B 11/55 42/54
(Continued)

OTHER PUBLICATIONS

Notification of Transmittal of International Search Report and the Written Opinion of the International Searching Authority for PCT/US2018/023665; dated Jul. 5, 2018.
(Continued)

*Primary Examiner* — Alexander R Niconovich
(74) *Attorney, Agent, or Firm* — Tope-McKay & Associates

(57) ABSTRACT

Described is a spitball gun that is operable for collecting, wetting, and projecting paper ammunitions. The spitball gun includes a paper advancing chamber having an opening for receiving paper ammunition and an advancing mechanism for advancing paper through the paper advancing chamber to a loading chamber. A water tank is also connected with the loading chamber. A sliding handle is used to cause paper to be pulled through the paper advancing mechanism while water is released onto the paper from the water tank. A paper cutter is used to cut the paper and load the paper into the loading chamber. Finally, air from an attached air tank is used to expel a wetted paper wad from the loading chamber and through the barrel of the spitball gun.

7 Claims, 22 Drawing Sheets

Related U.S. Application Data

(60) Provisional application No. 62/474,258, filed on Mar. 21, 2017, provisional application No. 62/915,471, filed on Oct. 15, 2019.

(51) Int. Cl.
*F41B 9/00* (2006.01)
*F41B 11/646* (2013.01)
*F41B 11/50* (2013.01)

(58) Field of Classification Search
USPC ..... 124/56, 65, 66, 67, 69, 82; 446/473; 222/79
See application file for complete search history.

(56) References Cited

U.S. PATENT DOCUMENTS 5,241,944 A * 9/1993 Rappaport ..... F41B 7/006 124/27
5,284,274 A * 2/1994 Lee ..... F41B 9/0065 124/65
5,377,656 A * 1/1995 Lewinski ..... F41B 9/0037 124/56
5,381,928 A * 1/1995 Lee ..... F41B 9/0031 124/65
5,448,984 A * 9/1995 Brovelli ..... F41B 9/0018 124/69
5,622,159 A * 4/1997 Liu ..... F41B 11/89 124/64
5,876,995 A * 3/1999 Bryan ..... A23L 17/30 435/189
6,247,995 B1 * 6/2001 Bryan ..... A23L 29/06 446/473
6,250,294 B1 * 6/2001 Lim ..... F41B 11/642 124/56
7,004,813 B2 * 2/2006 Zuloff ..... F41B 7/08 124/16
7,219,817 B2 * 5/2007 Panzarella ..... F41B 9/00 222/340
8,074,838 B1 * 12/2011 Tate ..... F41B 9/00 222/79
8,529,384 B2 * 9/2013 Corlett ..... F42B 12/367 473/581
8,584,589 B2 * 11/2013 Carlson ..... F42B 6/00 102/502
8,707,941 B2 * 4/2014 Carlson ..... F42B 6/10 124/66
8,726,894 B2 5/2014 Carlson
9,004,013 B2 * 4/2015 Bianchi ..... F42C 19/083 119/719
9,033,191 B2 * 5/2015 Jackson ..... F01C 17/063 222/383.2
9,958,230 B1 * 5/2018 Nugent ..... F41A 9/73
10,082,374 B2 * 9/2018 Marshall ..... F42B 6/10
2007/0006862 A1 * 1/2007 Zimmerman ..... F41B 11/646 124/66
2009/0301456 A1 * 12/2009 Barwick, Jr. ..... F41B 11/54 124/45
2010/0180878 A1 * 7/2010 Funaki ..... F41B 11/646 124/66
2011/0146645 A1 * 6/2011 Ma ..... F41B 11/54 124/59
2012/0024278 A1 * 2/2012 Carlson ..... F42B 6/10 124/65
2014/0083400 A1 * 3/2014 Falkowski, II ..... F41B 7/003 124/16
2017/0176130 A1 * 6/2017 Kang ..... F41B 7/08

OTHER PUBLICATIONS

International Search Report of the International Searching Authority for PCT/US2018/023665; dated Jul. 5, 2018.
Written Opinion of the International Searching Authority for PCT/US2018/023665; dated Jul. 5, 2018.
Notification of International Preliminary Report on Patentability for PCT/US2018/023665; dated Oct. 3, 2019.
International Preliminary Report on Patentability for PCT/US2018/023665; dated Oct. 3, 2019.
Office Action 1 for U.S. Appl. No. 15/927,924, dated Feb. 1, 2019.
Response to Office Action 1 for U.S. Appl. No. 15/927,924, dated Jun. 3, 2019.
Office Action 2 for U.S. Appl. No. 15/927,924, dated Sep. 30, 2019.
Response to Office Action 2 for U.S. Appl. No. 15/927,924, dated Oct. 15, 2019.
Notice of Allowance for U.S. Appl. No. 15/927,924, dated Oct. 22, 2019.

* cited by examiner

#4

SPITBALL GUN FOR USE WITH PAPER AMMUNITION

CROSS-REFERENCE TO RELATED APPLICATIONS

The present application is a Continuation-in-Part application of Ser. No. 15/927,924, filed Mar. 21, 2018, which is a Non-Provisional Utility Patent Application of U.S. Provisional Application No. 62/474,258, filed on Mar. 21, 2017, entitled, "Spitball Gun for Use with Paper Ammunition," the entirety of which are incorporated herein by reference.

The present application is ALSO a Non-Provisional Utility Patent Application of U.S. Provisional Application No. 62/915,471, filed on Oct. 15, 2019, entitled, "Spitball Gun for Use with Paper Ammunition," the entirety of which is incorporated herein by reference.

BACKGROUND OF THE INVENTION

(1) Field of Invention

The present invention relates to a spitball gun and, more particularly, to a gun that is operable for collecting, wetting, and projecting paper ammunitions.

(2) Description of Related Art

Spitball guns have long been known in the art and are traditionally comprised of a simple straw and compressed paper that is literally wetted with saliva. As can be appreciated, such a process is unsanitary and requires a considerable amount of effort.

Thus, a continuing need exists for a spitball gun that is operable for automatically wetting and projecting paper ammunitions.

SUMMARY OF INVENTION

This disclosure is directed to a spitball gun that is operable for collecting, wetting, and projecting paper ammunitions. The spitball gun includes a paper advancing chamber having an opening for receiving paper ammunition and an advancing mechanism for advancing paper through the paper advancing chamber; a loading chamber for receiving paper from the paper advancing chamber; an air tank fluidly connected with the loading chamber; a barrel connected with the loading chamber, whereby paper loaded into the loading chamber is expelled from the barrel by air from the air tank; a water tank fluidly connected with the loading chamber, the water tank having a water release mechanism; and a sliding handle operably connected with the advancing mechanism and the water release mechanism, such that sliding motion of the sliding handle causes paper to be pulled through the paper advancing mechanism while water is released onto the paper from the water tank.

In another aspect, a paper cutter is housed within the spitball gun, the paper cutter positioned proximate the loading chamber to cut paper as loaded into the loading chamber.

In another aspect, the spitball gun further includes a sliding rod attached with the sliding handle, the sliding rod having gear teeth; a gear train operably connected with the gear teeth of the sliding rod and the advancing mechanism; an elongated rod operably connected with the gear train, the elongated rod having a distal end operating as a loading plunger, such that sliding the sliding handle backwards cuts a piece of paper and, via the loading plunger, forces the paper into the loading chamber.

In another aspect, the paper cutter is operably connected with the sliding handle such that motion of the sliding handle causes the paper cutter to slide into a cutting position.

In yet another aspect, the elongated rod is spring loaded and further comprises a proximal end terminating with an air plunger.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a spitball gun and, more particularly, to a gun that is operable for collecting, wetting, and projecting paper ammunitions. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
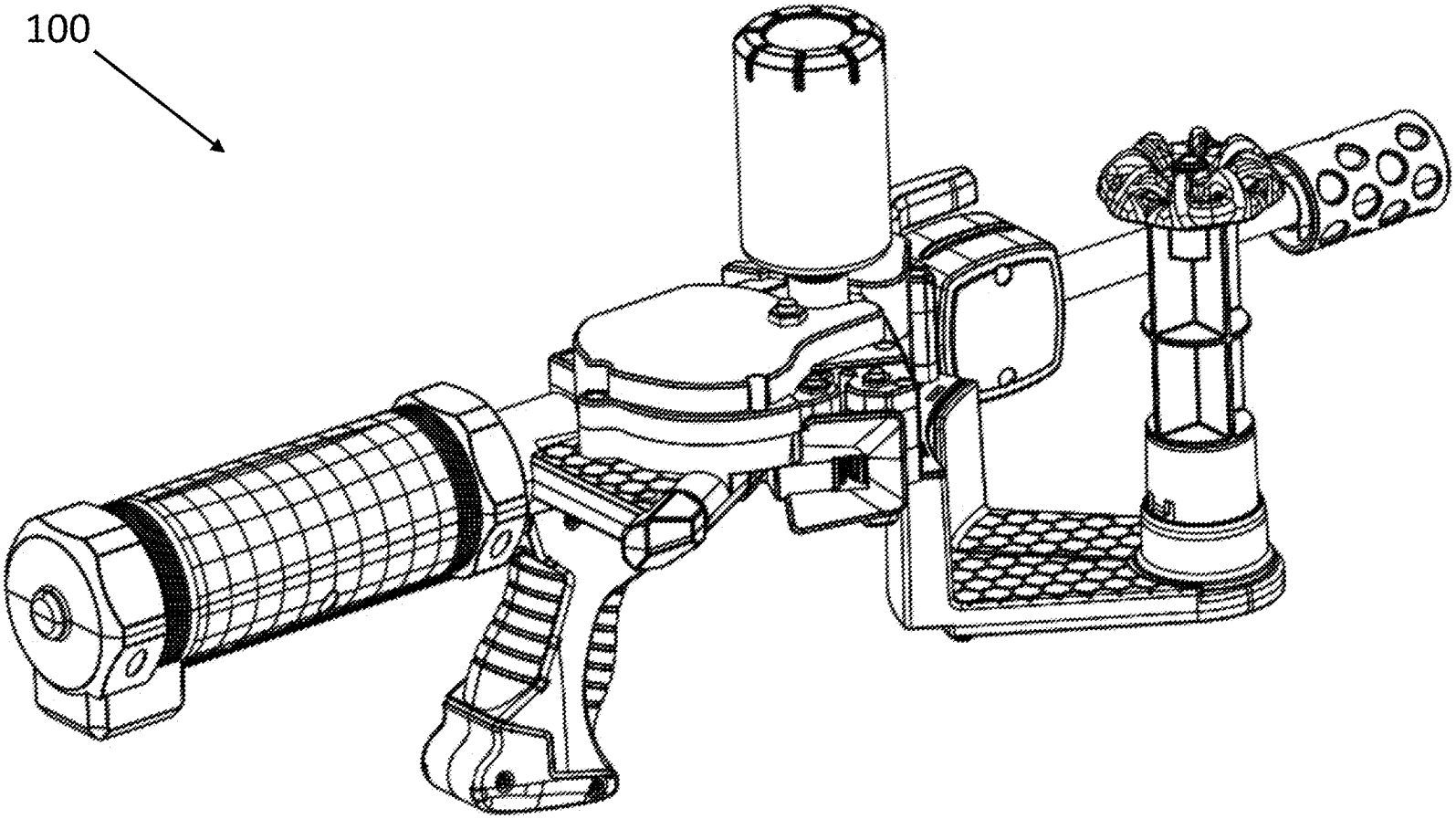
FIG. 1 is a right, perspective-view illustration of a spitball gun according to some embodiments of the present invention.
Figure 2:
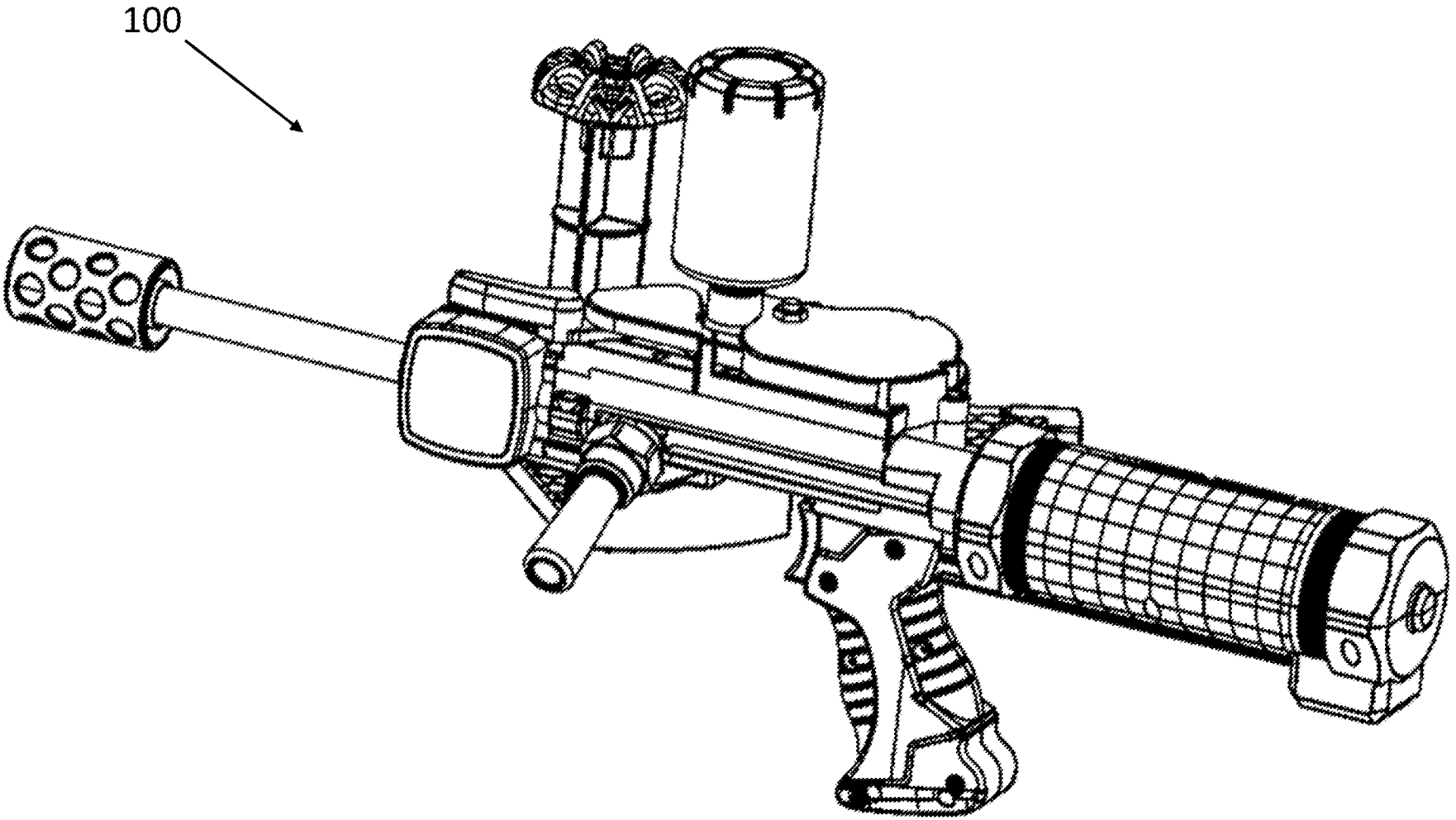
FIG. 2 is a left, perspective-view illustration of the spitball gun according to some embodiments of the present invention.
Figure 3A:
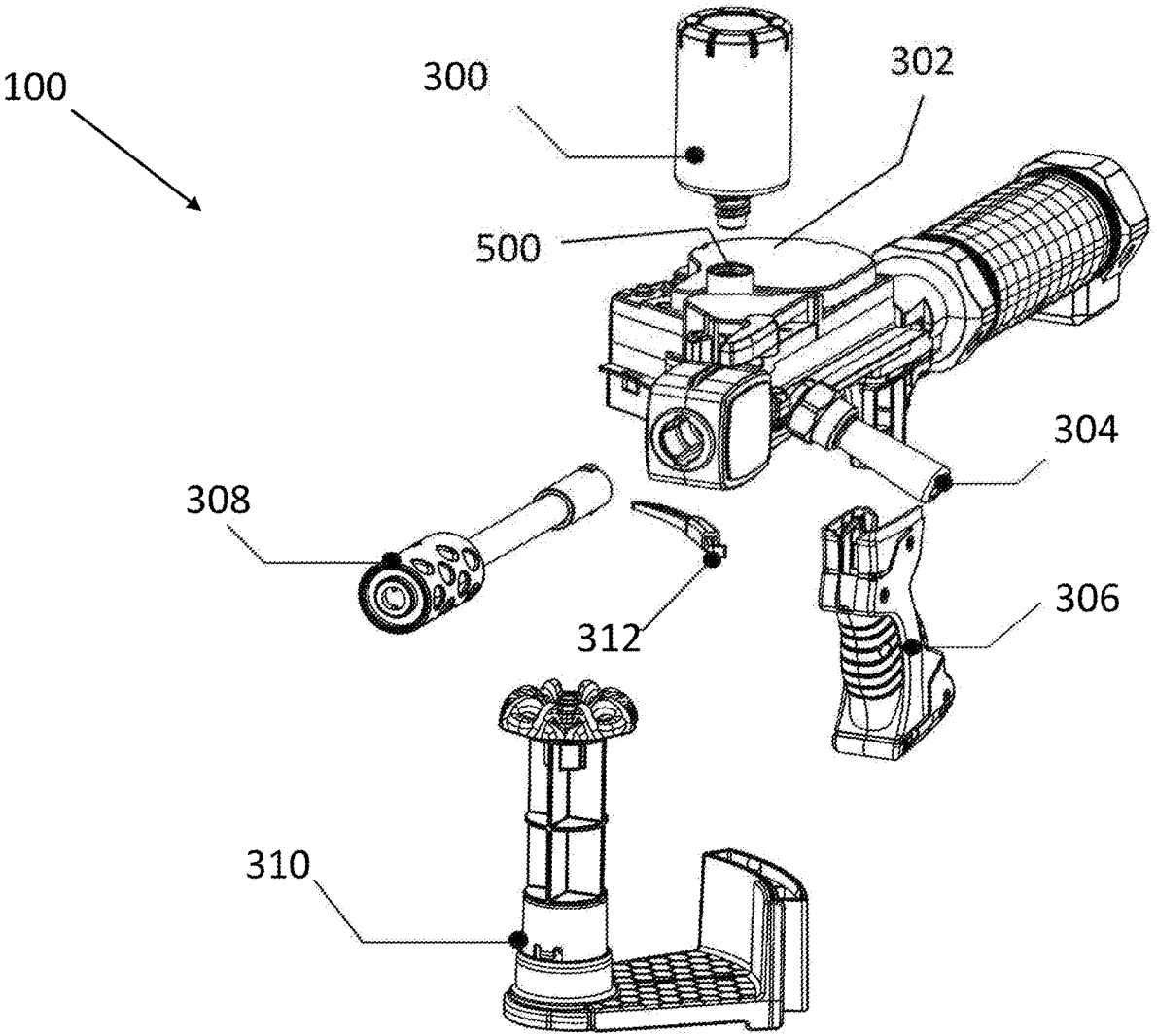
FIG. 3A is a partially, exploded-view illustration of the spitball gun according to some embodiments of the present invention.

As shown in FIGS. 1 and 2, this disclosure is directed to a spitball gun 100 that is operable for collecting, wetting, and projecting paper ammunitions. Another illustration of the spitball gun 100 is provided in FIG. 3A. As shown, the spitball gun includes a water tank 300, a paper advancing chamber 302, a firing pin handle 304, an actual handle 306, a barrel 308, a paper roll holder 310, and, desirably, a jam pick 312. During operation, a user can position a paper roll (e.g., toilet paper or other suitable rolled material) on the paper roll holder 310, which is fed into the paper advancing chamber 302. It should be noted that the spitball gun 100 can be used with toilet paper ammunition, paper towel ammunition, or any pulp or paper-like ammunition.

In some aspects, the paper roll holder 310 includes a spindle for holding a roll paper and allowing the ammunition roll to rotate as ammunition roll paper is fed into loading system. The spindle can be horizonal, vertical, or at any angle relative to gun barrel 308 axis. In other aspects, the paper roll holder 310 can include a pivot member allowing it to pivot away from the loading system to allow more space for loading ammunition paper.

Figure 3B:
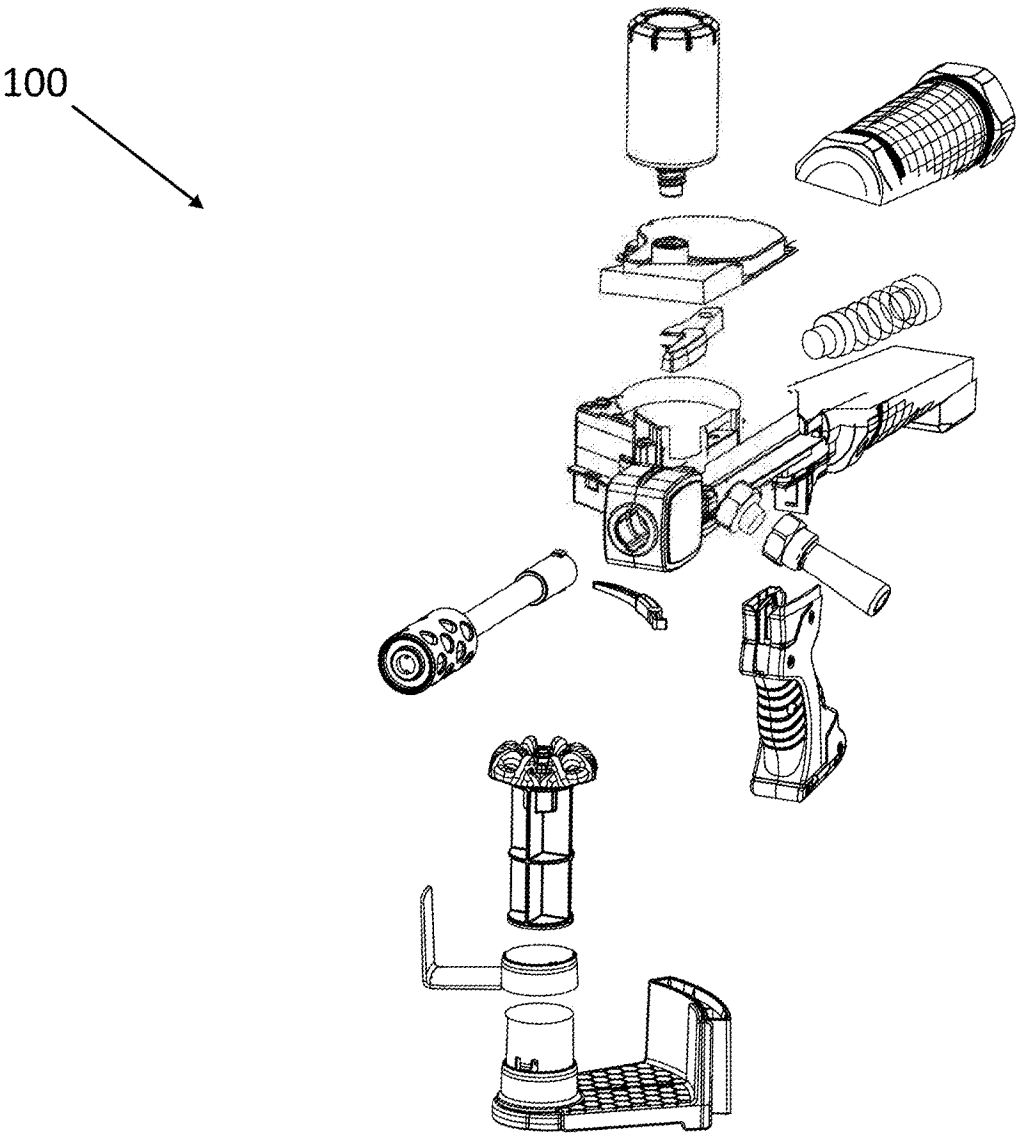
FIG. 3B is a partially, exploded-view illustration of the spitball gun according to some embodiments of the present invention.
Figure 3C:
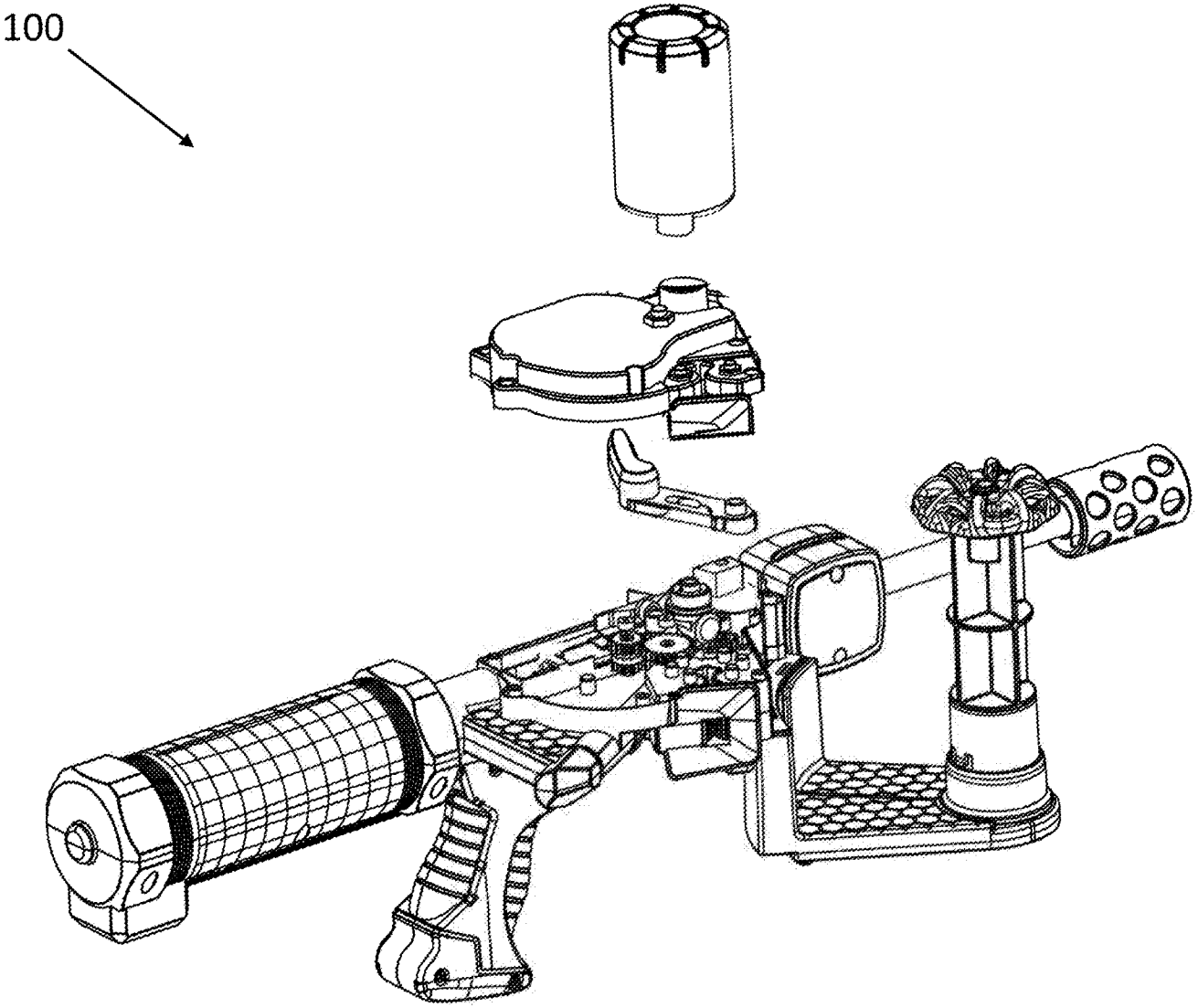
FIG. 3C is a partially, exploded-view illustration of the spitball gun according to some embodiments of the present invention.

Once the paper is loaded in the paper advancing chamber 302, the paper from the paper roll is indexed through the spitball gun 100, where it is wet, cut, and ultimately shot from the barrel 308. For further understanding, FIGS. 3B and 3C also depict exploded-view illustrations of the spitball gun 100/. The spitball gun 100 includes any of the necessary components as may be required to wet, cut and shoot a paper wad. While a specific example is provided herein, it should be understood that the various components can be altered as desired provided the resulting spitball gun operates to effectively shoot a spitball. Thus, the invention as described below is not intended to be limited thereto.

Figure 4A:
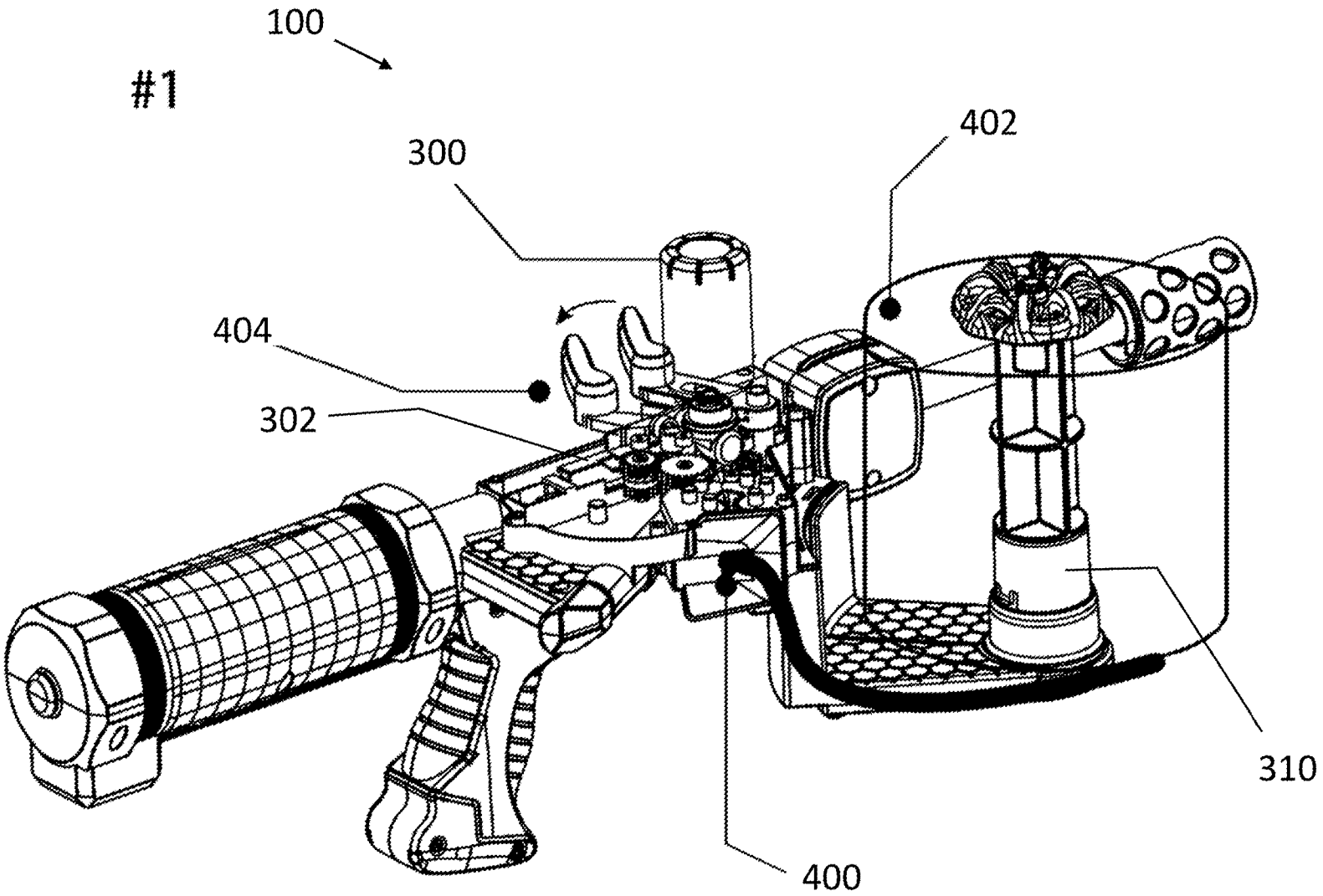
FIG. 4A is a right, perspective-view illustration of the spitball gun according to some embodiments of the present invention, depicting a stepwise process of using the spitball gun.

For further understanding, FIGS. 4A through 4D illustrate the stepwise process of loading and projecting the paper projectile. Specifically, FIG. 4A depicts the spitball gun 100 with a cover of the advancing chamber 302 removed for illustrative purposes. To operate, the water tank 300 must be filled with water or other suitable solution. A roll of paper 402 can then be positioned onto the paper roll holder 310. The end of the paper 402 is then rolled up and fed into an opening 400 of the advancing chamber 302. The opening 400 is desirably a rounded or tapered entrance for the paper ammunition so as not to rip or tear as it enters the advancing chamber 302.

Figure 4B:
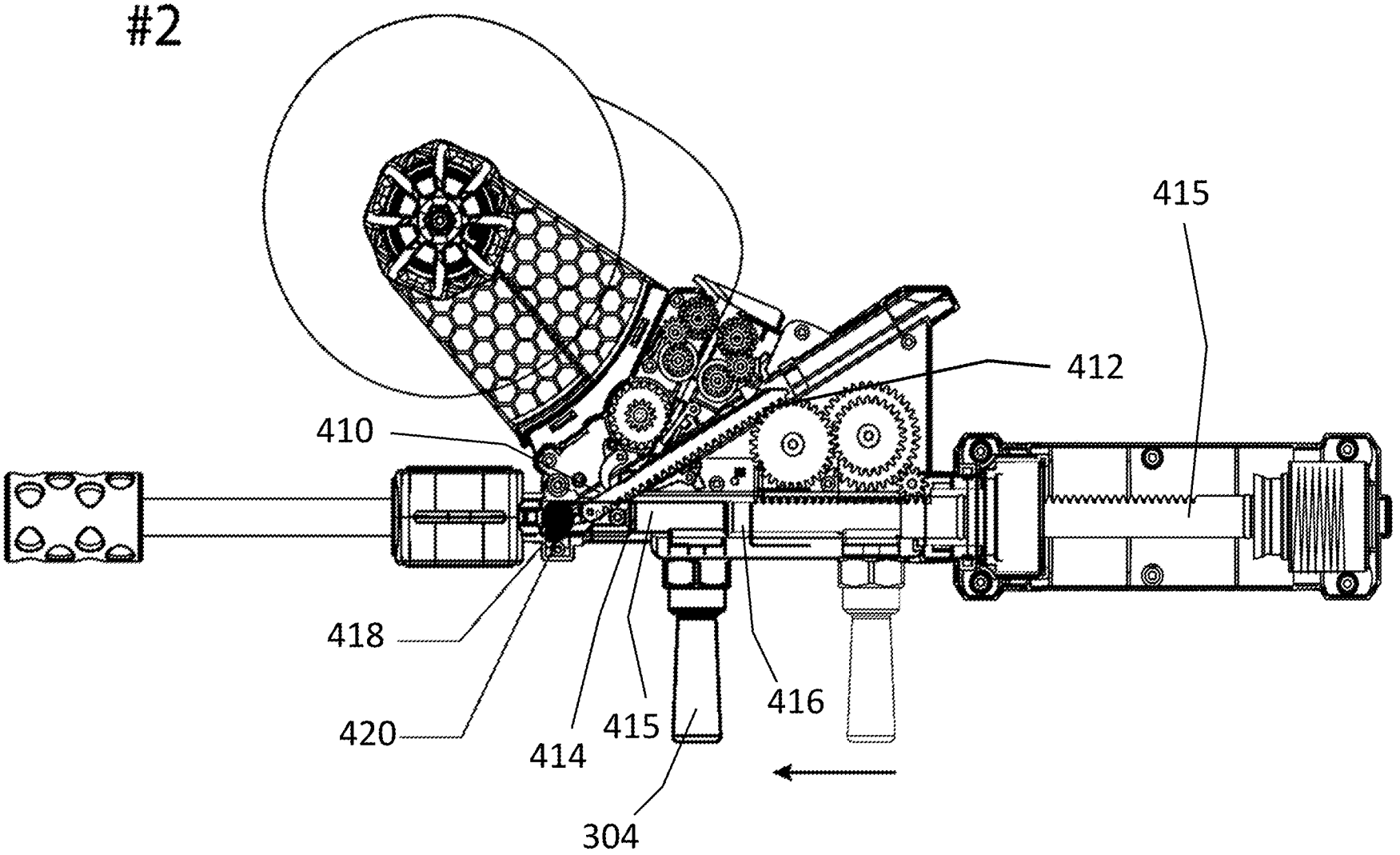
FIG. 4B is a top-view illustration of the spitball gun according to some embodiments of the present invention, depicting a stepwise process of using the spitball gun.

An indexing lever 404 is then used (e.g., by being pulled back and forth) to wet the paper and index the paper into a channel (depicted as element 410 in FIG. 4B). The indexing lever 404 is operably connected with an advancing mechanism (the gears and/or other advancing elements (e.g. rollers)) in the advancing chamber 302 to draw the paper 402 through the advancing chamber 302. Additionally, the indexing lever 404 is desirably connected with a water release mechanism (e.g., a pump or valve) for releasing water from the water tank 300. As a non-limiting example, the indexing lever 404 is operably connected with a valve (or pump) that when moved, allows water to escape from the water tank 300 onto the indexed paper 402. Thus, in some aspects, the loading chamber, water tank, and water pump are all in fluid communication with one another.

FIG. 4B illustrates the paper 402 as positioned in the channel 410, where a paper cutter 412 slideably resides. The paper cutter 412 is operably connected with the firing pin handle 304, via, for example, a series of gears and/or gearing engaged with an elongated rod (as described below) to move the paper cutter 412 into a cutting position (as depicted). The firing pin handle 304 also includes a loading plunger 414 that slideably resides in a loading plunger housing 416 proximate a loading chamber 418. During operation, a user can push the firing pin handle 304 forward, which feeds and cuts the paper into the loading chamber 418, thereby forming a paper wad 420 that is cut and compressed into the loading chamber 418.

The loading plunger 414 is, desirably, spring loaded so as to remain in a starting or resting position when not in use. In various embodiments, the loading plunger 414 includes an elongated rod 415 with an engagement end (i.e., loading plunger 414) and a laterally projecting firing pin handle 304 that can be used to slide the loading plunger 414 within the loading plunger housing 416. In various aspects, the engagement end includes one or more teeth or protrusions to improve engagement with ammunition. In some aspects, the elongated rod includes a linear guide feature to engage with the loading plunger housing 416.

The loading plunger housing 416 includes an opening or ammunition inlet for accepting paper, while the loading chamber 418 also include a rounded or tapered entrance for the paper ammunition so as not to rip or tear as it enters loading chamber 418.

Figure 4C:
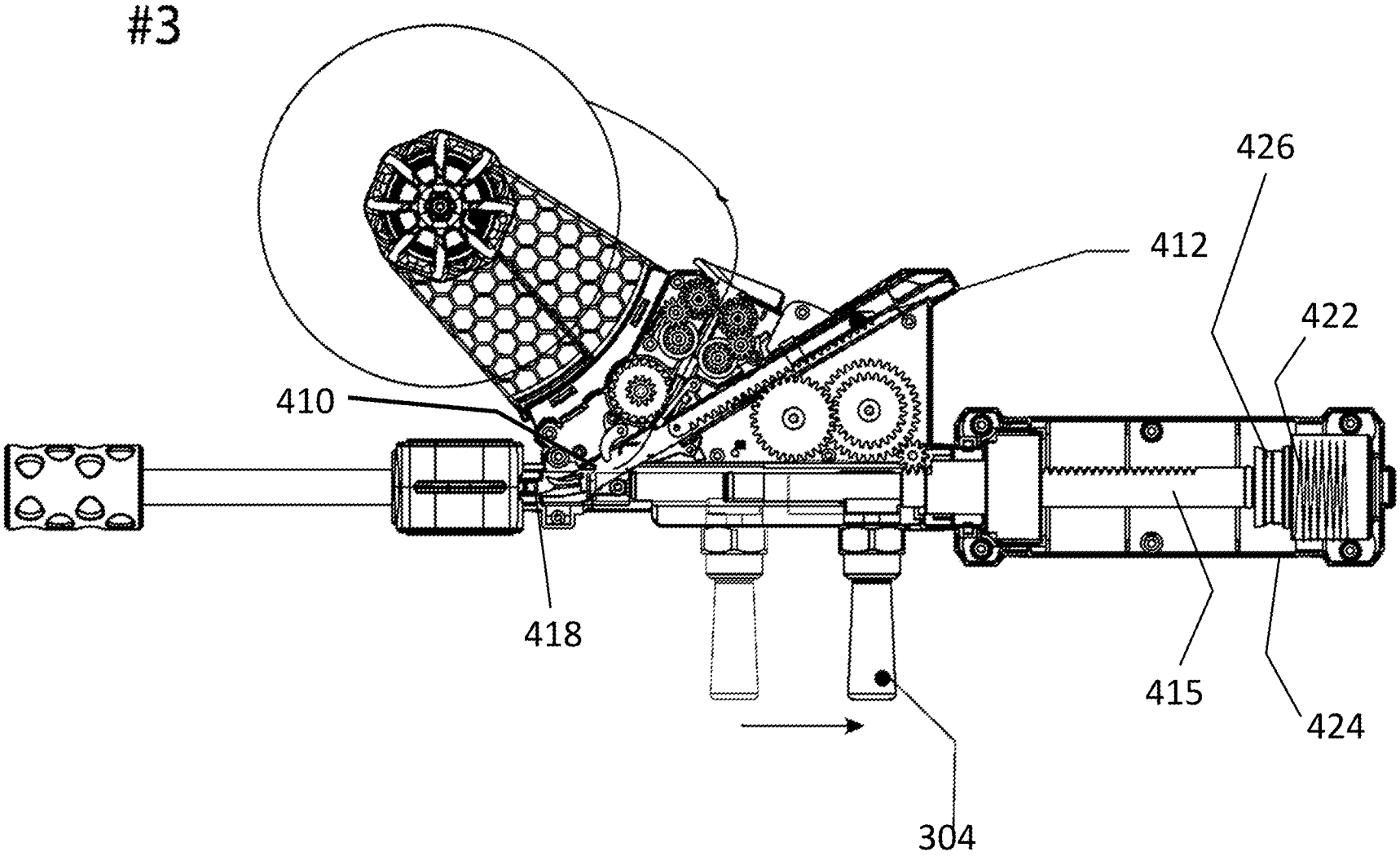
FIG. 4C is a top-view illustration of the spitball gun according to some embodiments of the present invention, depicting a stepwise process of using the spitball gun.

As shown in FIG. 4C, pulling back the firing pin handle 304 causes the elongated rod 415 extending from the firing pin handle 304 to slide back and compress a spring 422 in the air tank 424. Note that the elongated rod 415 includes an air plunger 426 on its proximate end. Also note that teeth are formed on the side of the elongated rod 415 to engage with the paper cutter 412. Drawing back the firing pin handle 304 and its attached elongated rod 415 causes the paper cutter 412 to withdraw up the channel 410 and further away from the loading chamber 418. Once the spring 422 is compressed, a pawl or other mechanism can be used to lock the elongated rod 415 such that the spring 422 is maintained in the compressed state.

Figure 4D:
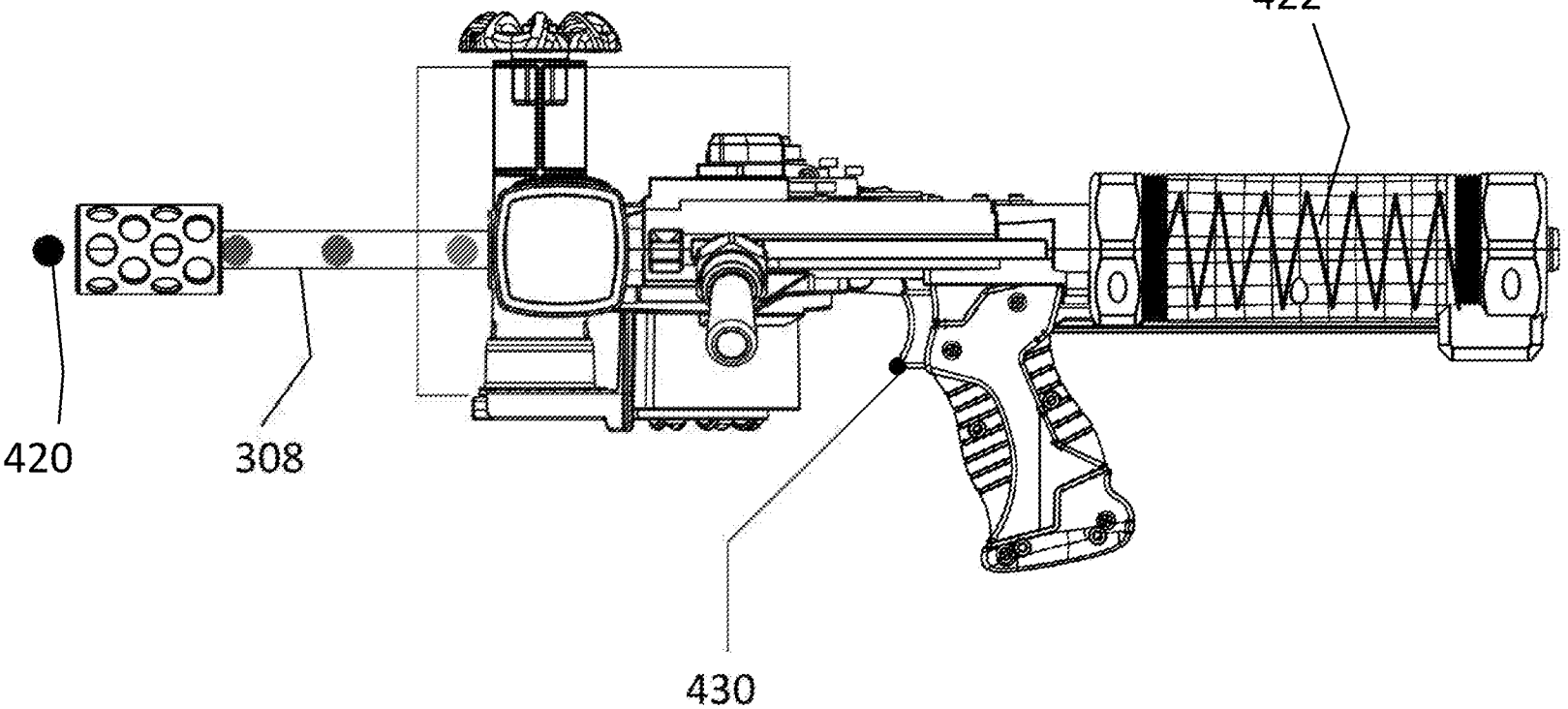
FIG. 4D is a left-view illustration of the spitball gun according to some embodiments of the present invention, depicting a stepwise process of using the spitball gun.

As shown in FIG. 4D, a trigger mechanism 430 can be included that is operably connected with the pawl or other device that is maintaining the locked configuration of the elongated rod. Squeezing the trigger mechanism 430 causes the pawl or other device to release the elongated rod, which in effect releases the spring 422 and allows the air plunger to propel forward and force air from the barrel 308 and, in doing so, blast the paper wad 420 from the spitball gun 100.

Figure 5:
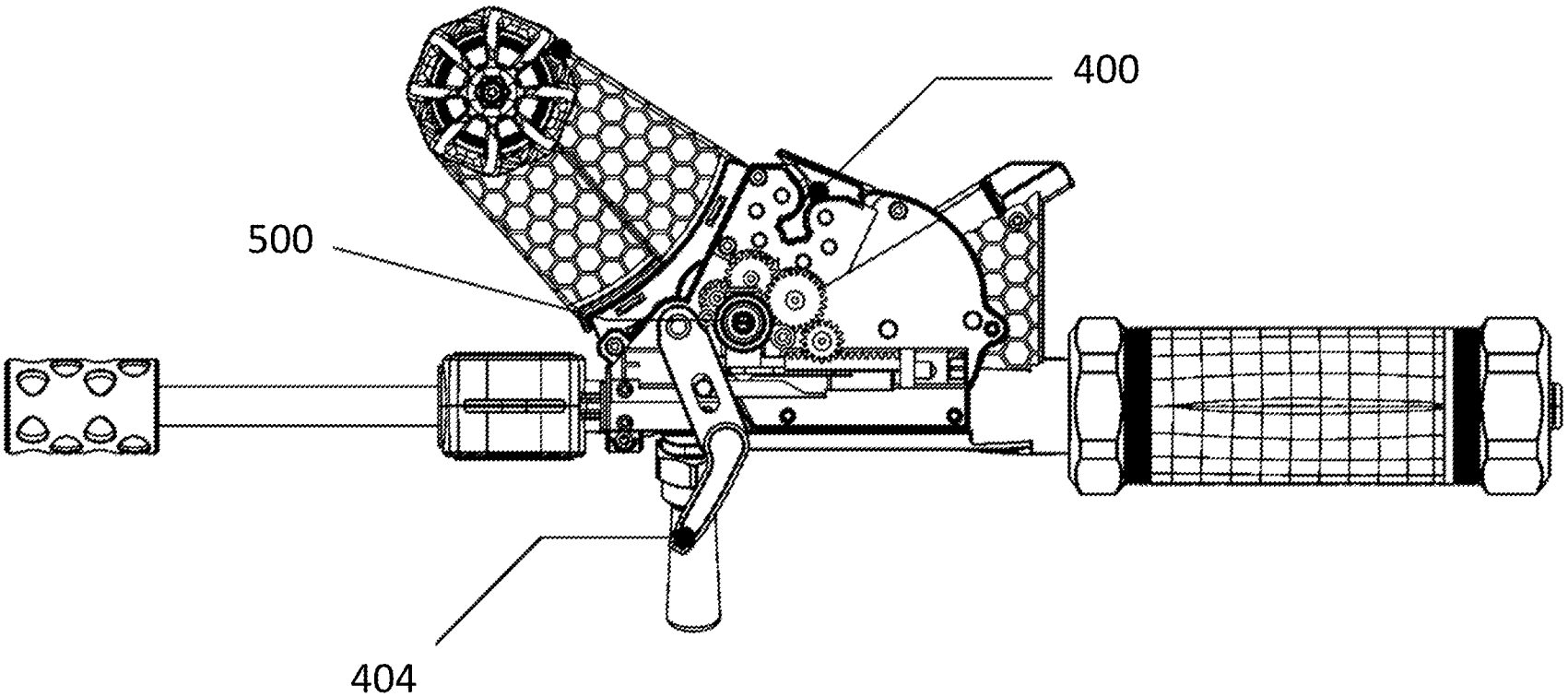
FIG. 5 is a top-view illustration of the spitball gun according to some embodiments of the present invention.
Figure 6:
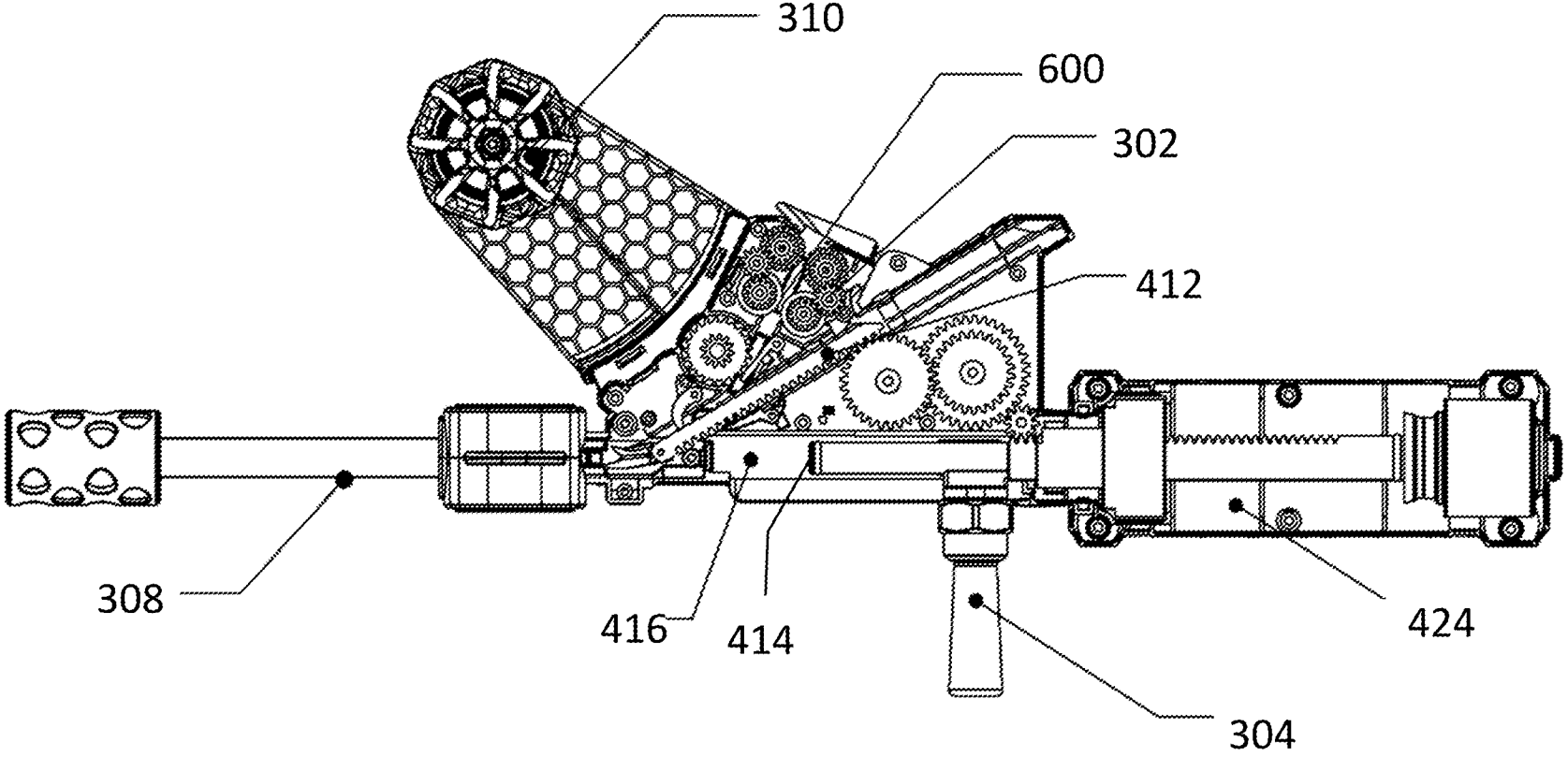
FIG. 6 is a top-view illustration of the spitball gun according to some embodiments of the present invention.

For further understanding, FIGS. 5 and 6 provide interior, top-view illustrations of the spitball gun 100 without a paper roll. As shown in FIG. 5, the water tank feeds into a water chamber 500 (also shown in FIG. 3), while dry paper is fed into an opening on the side of the spitball gun 100. The indexing handle 404 can then be pulled back and forth to feed the paper into the loading chamber while simultaneously wetting, cutting and constructing the paper wads to shoot. As shown in FIG. 6, the paper holder 310 holes paper which can be fed through the paper advancing chamber 302 (and its gears) and toward the paper cutter 412. After getting wet, cut and wadded, a user can pull back the firing pin handle 304 which pulls back the loading plunger 414 within the loading plunger housing 416 and compresses a spring in the air tank 424. Pulling a trigger (not show), allows the spring force the loading plunger 414 forward and ultimately project the paper wad from the barrel. Desirably, a hatch door 600 or other access point is provided (e.g., on the bottom of the paper advancing chamber 302) to allow user to remove paper jams within the spitball gun 100.

Another aspect of the spitball gun 700 is depicted in FIGS. 7 through 17. To be contrasted with the aspect as depicted in FIG. 1 through 6, the embodiment as depicted in FIGS. 7 through 17 includes a sliding handle 702. The sliding handle 702 operates in a manner similar to the firing pin handle (i.e., element 304 in FIGS. 1 through 6). In this case, the sliding handle 702 is connected with the elongated rod 415 using any suitable mechanism or technique to cause the elongated rod 415 to operate as described above. Thus, the aspect as shown in FIGS. 7 through 17 similarly includes the elongated rod 415 and relevant components as shown in FIGS. 1 through 6. However, the mechanism is operated through pumping back and forth the sliding handle 702. Further, while the sliding handle 702 can be directly connected with the elongated rod 415, in another aspect, the sliding handle 702 is attached to (e.g., clipped or otherwise adhered to) a sliding rod (depicted as element 1600 in FIGS. 16 and 17) that has teeth for engaging with a gear train 1602 which operable engages with the elongated rod 415 to move the elongated rod 415 and advancing mechanism (the gears and/or other advancing elements (e.g. rollers)) in the advancing chamber 302 to draw the paper 402 through the advancing chamber 302.

Figure 7:
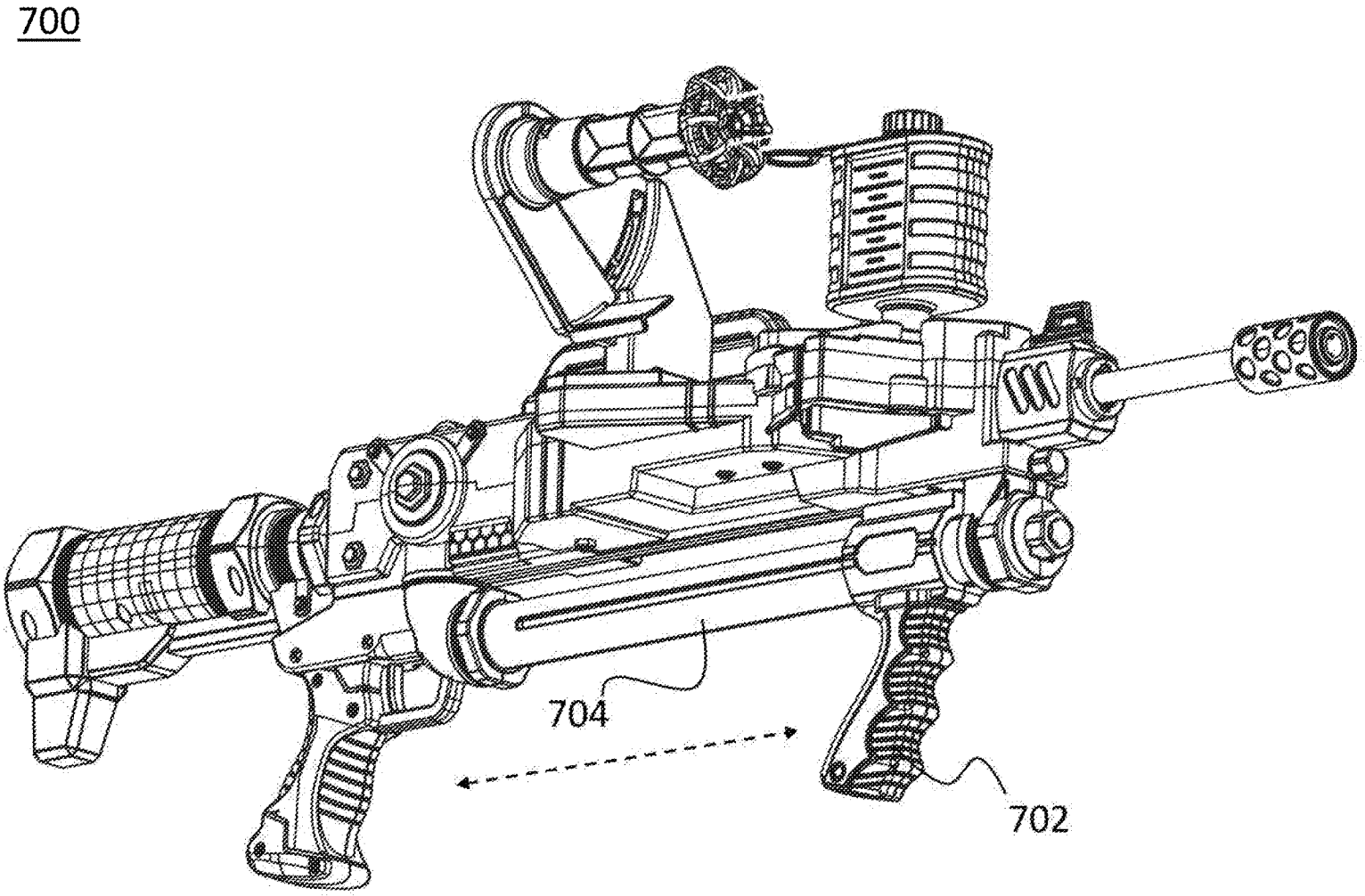
FIG. 7 is a right side, three-quarter view illustration of a spitball gun according to some embodiments of the present invention.
Figure 8:
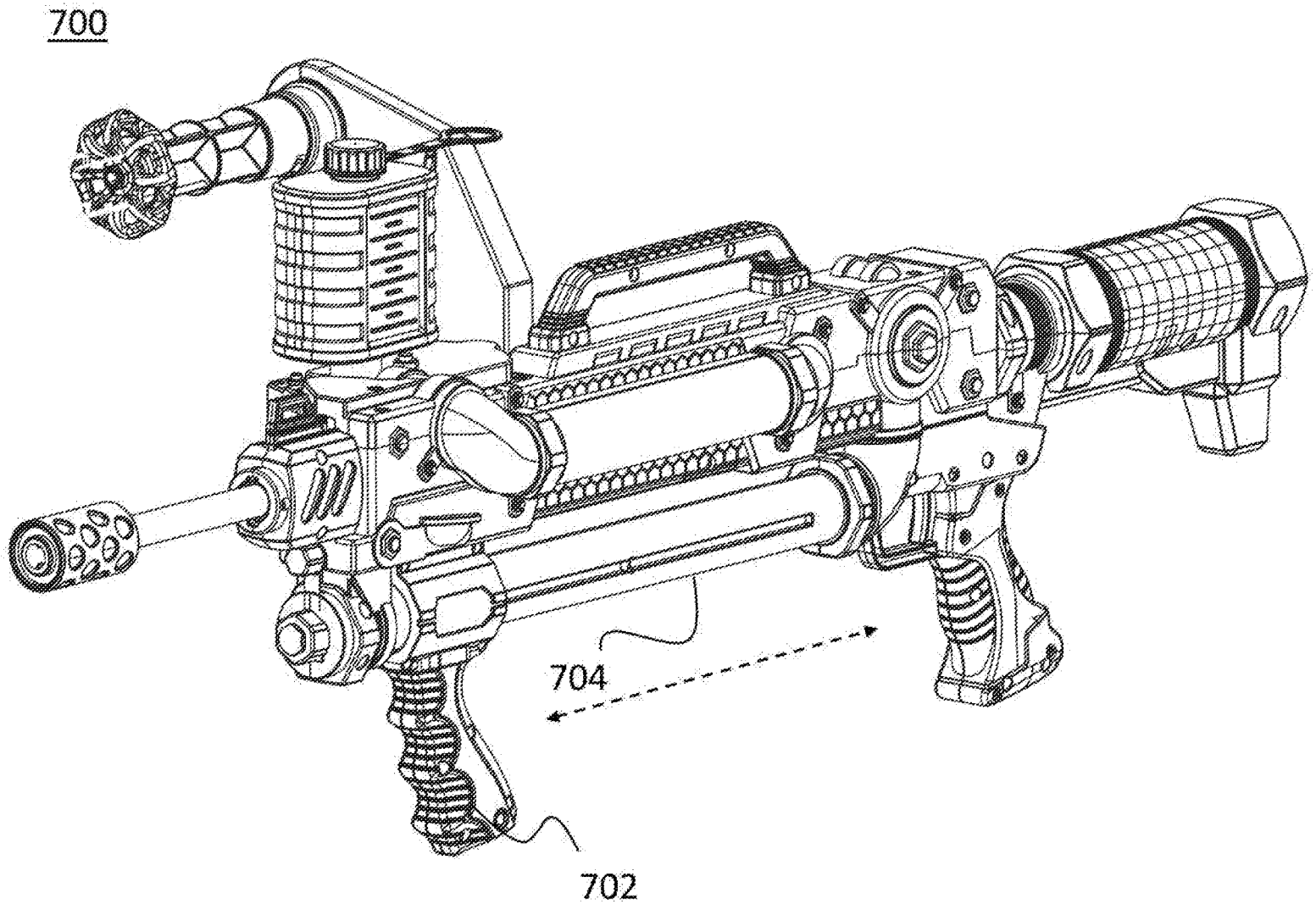
FIG. 8 is a left side, three-quarter view illustration of the spitball gun as depicted in FIG. 7.
Figure 9:
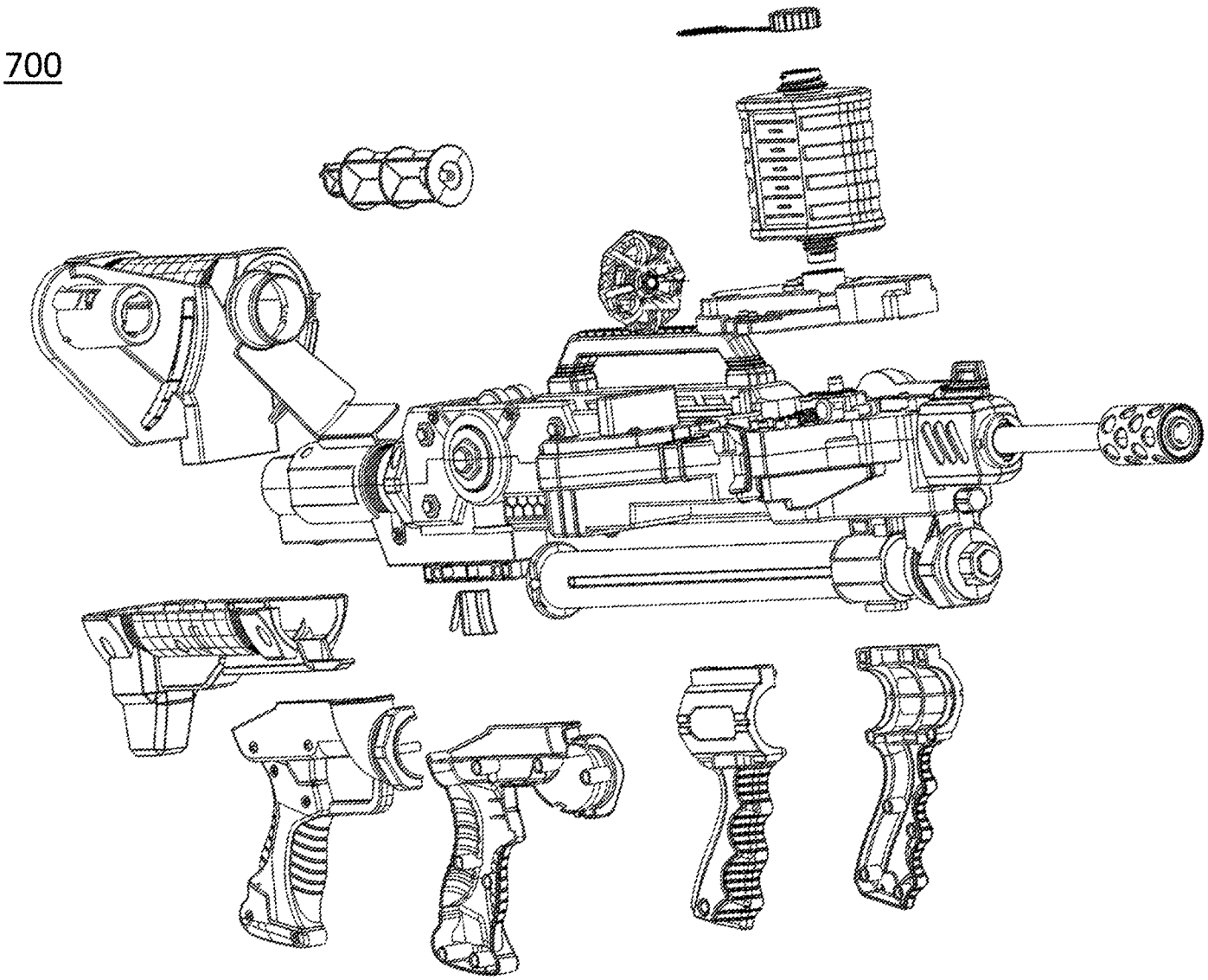
FIG. 9 is an exploded, right side view illustration of the spitball gun as depicted in FIG. 7.
Figure 10:
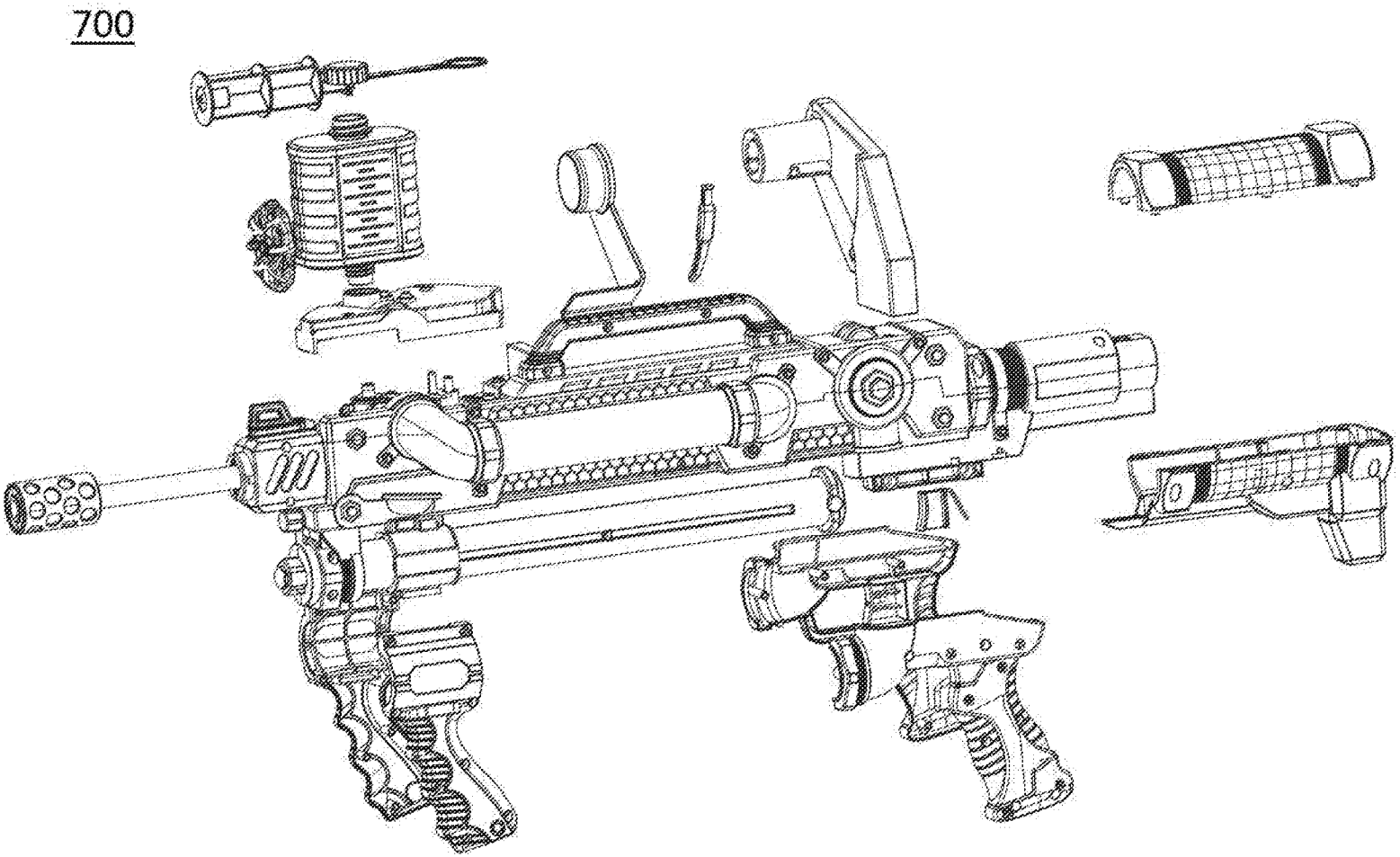
FIG. 10 is an exploded, left side view illustration of the spitball gun as depicted in FIG. 7.

Further and as shown in FIGS. 7 and 8, the sliding handle 702 is slideably connected with a sliding platform 704. In this case, the sliding platform 704 is an elongated platform around which the sliding handle 702 is attached and allowed to slide. The sliding handle 702 extends into the housing of the spitball gun 700 where it is connected to the sliding rod (element 1600 in FIGS. 16 and 17) and, thereby, the elongated rod 415 by virtue of the gear train (depicted as element 1602 in FIGS. 16 and 17).

Figure 11:
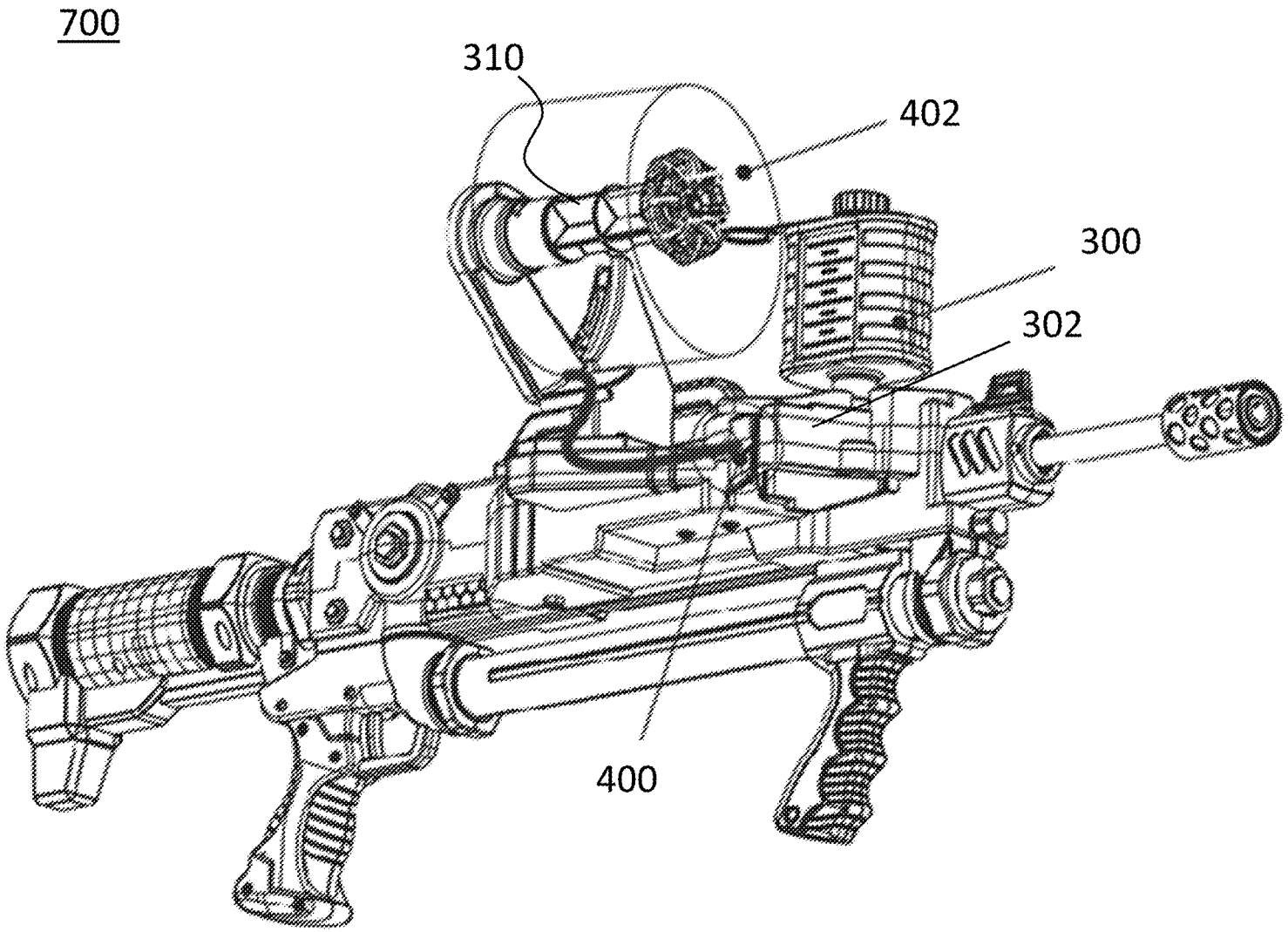
FIG. 11 is an illustration depicting a toilet paper roll as connected with the spitball gun as depicted in FIG. 7.

In operation and as shown in FIG. 11, a user loads a roll of paper 402 onto the paper roll holder 310 and provides fluid, such as water, into the water tank 300. The end of the paper 402 is then rolled up and fed into an opening 400 of the advancing chamber 302. As was the case above, the opening 400 is desirably a rounded or tapered entrance for the paper ammunition so as not to rip or tear as it enters the advancing chamber 302.

Instead of an indexing lever and firing pin handle, the aspect as depicted in FIGS. 7 through 17 includes the sliding handle 702 that is operably connected with the internal gears and/or advancing elements via the sliding rod and elongated rod. As shown in FIGS. 12A through 13B, the sliding handle 702 is pulled back to load, wet, compress a paper wad, and compress the spring. As noted above, the sliding handle 702 is operably connected with an advancing mechanism (the gears and/or other advancing elements (e.g. rollers)) in the advancing chamber 302 to draw the paper 402 through the advancing chamber 302. Additionally, the sliding handle 702 is desirably connected (via, for example, the elongated rod) with a water release mechanism (e.g., a pump or valve) for releasing water from the water tank 300. As a non-limiting example, the elongated rod is operably connected with a valve (or pump) that when moved, allows water to escape from the water tank 300 onto the indexed paper 402. Thus, in some aspects, the loading chamber, water tank, and water pump are all in fluid communication with one another.

Figures 12A, 12B:
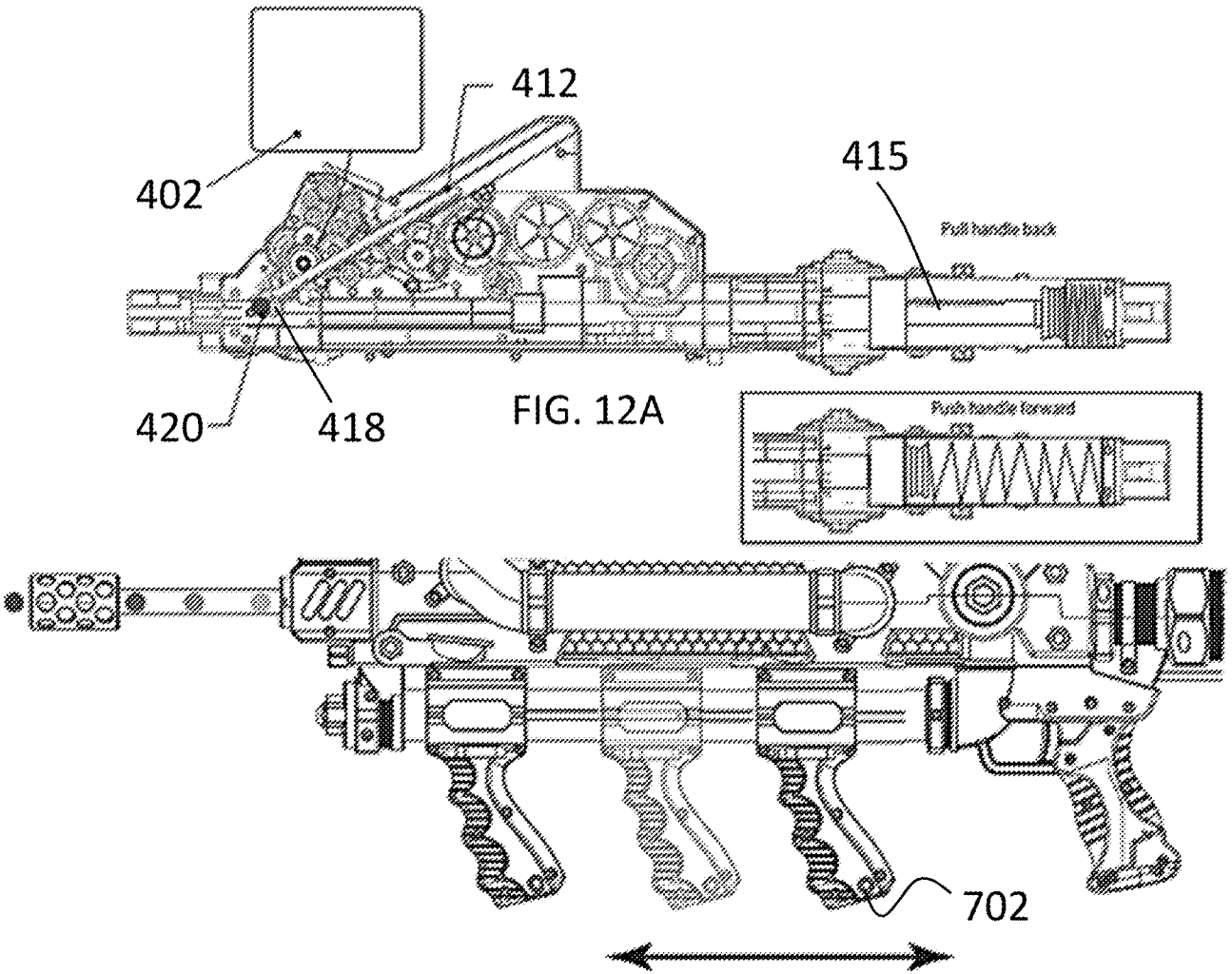
FIG. 12A is an interior, top-view illustration of the spitball gun as depicted in FIG. 7.
FIG. 12B is a side-view illustration the spitball gun as depicted in FIG. 7.
Figure 13A:
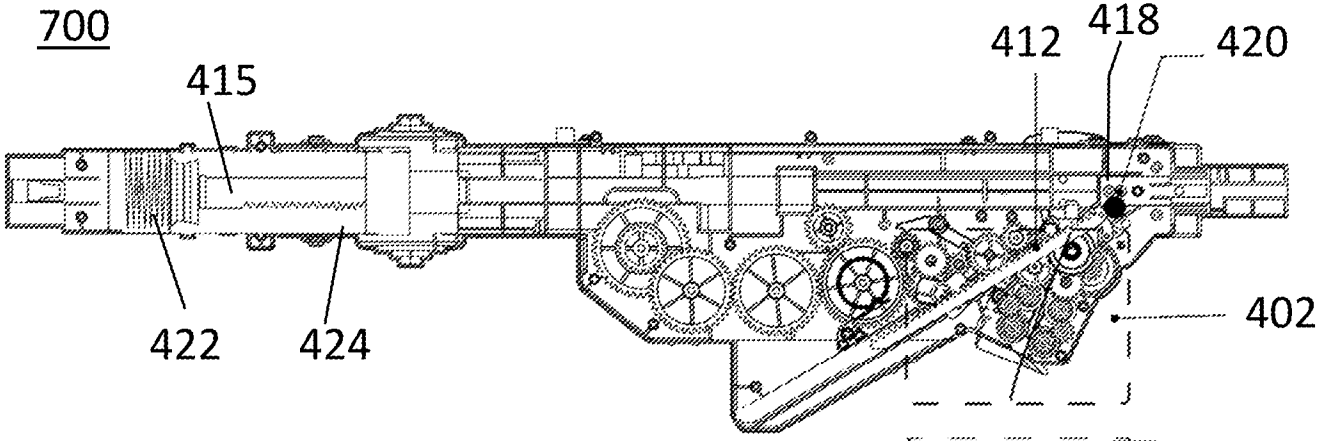
FIG. 13A is an interior, top-view illustration of the spitball gun as depicted in FIG. 7.

FIGS. 12A and 13A illustrates the paper 402 as positioned in the channel where a paper cutter 412 slideably resides. The paper cutter 412 is operably connected with the sliding handle 702, via, for example, the sliding rod and a series of gears and/or gearing engaged with an elongated rod 415 to move the paper cutter 412 into a cutting position (as depicted). In various aspects, a loading plunger is also included that slideably resides in a loading plunger housing proximate a loading chamber 418. During operation, a user can push pull the sliding handle 702 back, which feeds and cuts the paper into the loading chamber 418, thereby forming a paper wad 420 that is cut and compressed into the loading chamber 418.

The loading plunger is, desirably, spring loaded so as to remain in a starting or resting position when not in use. In various embodiments, the loading plunger includes an elongated rod 415 with an engagement end (i.e., loading plunger). In various aspects, the engagement end includes one or more teeth or protrusions to improve engagement with ammunition.

The loading plunger housing includes an opening or ammunition inlet for accepting paper, while the loading chamber 418 also include a rounded or tapered entrance for the paper ammunition so as not to rip or tear as it enters loading chamber 418.

Figure 13B:
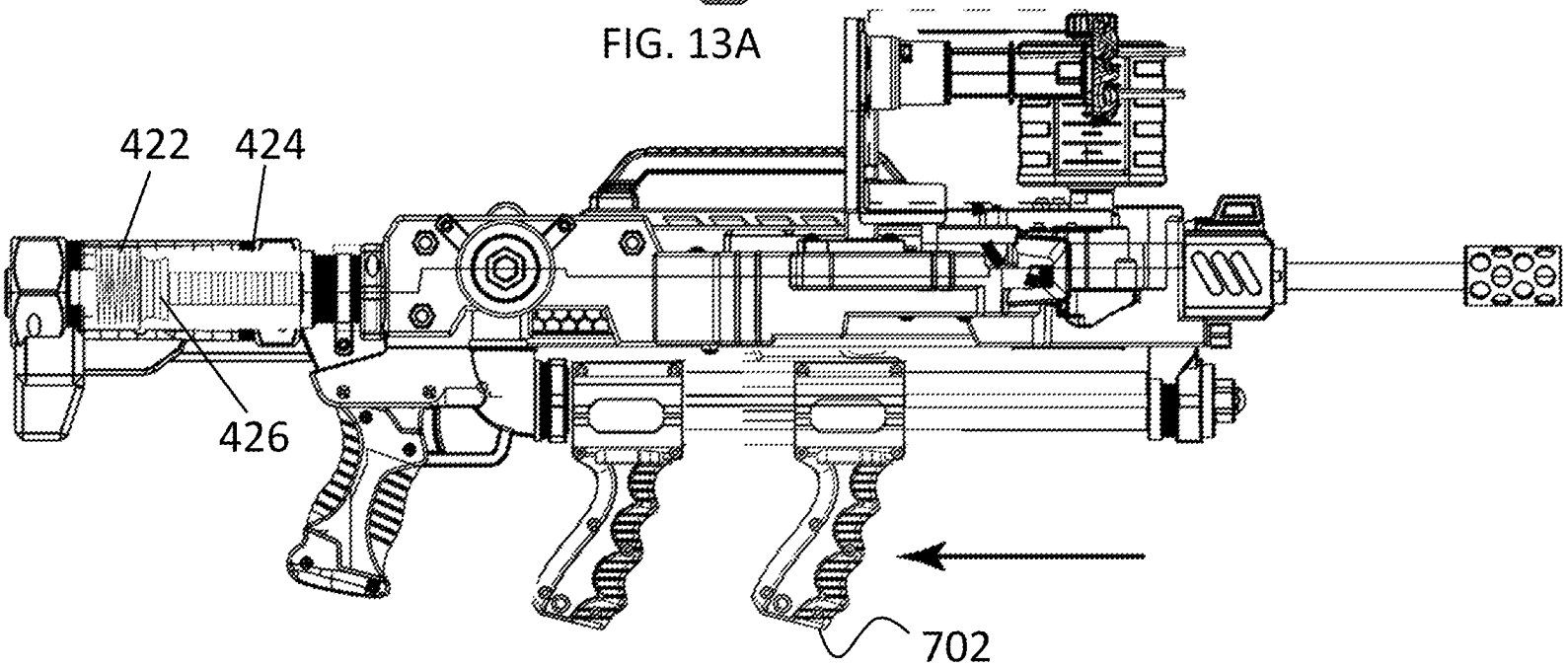
FIG. 13B is a side-view illustration of the spitball gun as depicted in FIG. 7.

As shown in FIGS. 13A and 13B, pulling back the sliding handle 702 causes the elongated rod 415 (by virtue of the sliding rod and gear train) to slide back and compress a spring 422 in the air tank 424. Note that the elongated rod 415 includes an air plunger 426 on its proximate end. Also note that teeth are formed on the side of the elongated rod 415 to engage with the paper cutter 412.

Figure 14A:
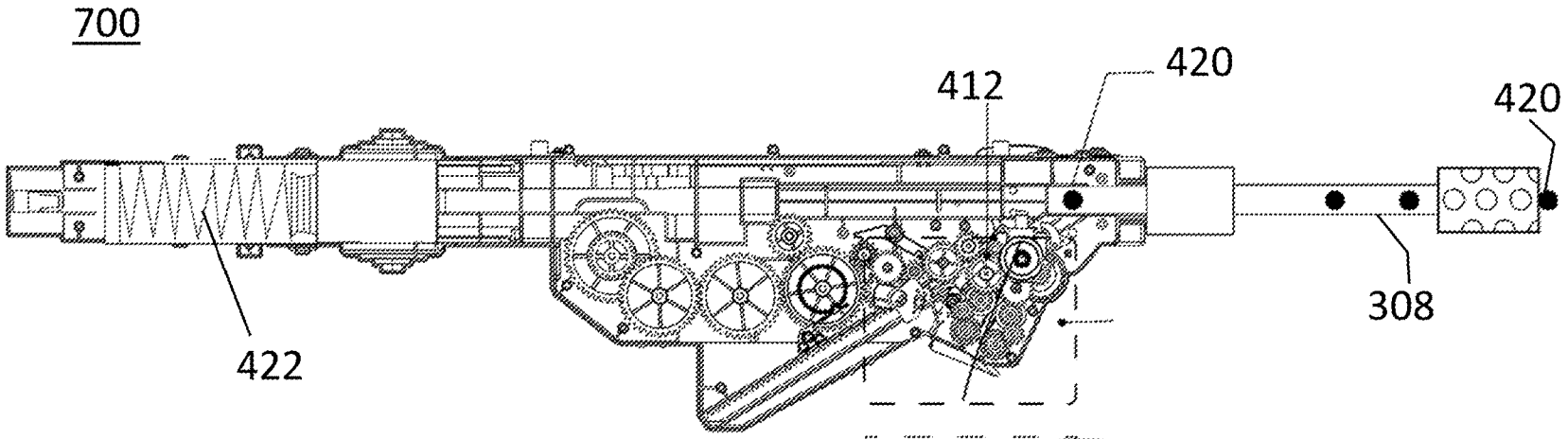
FIG. 14A is an interior, top-view illustration of the spitball gun as depicted in FIG. 7.
Figure 14B:
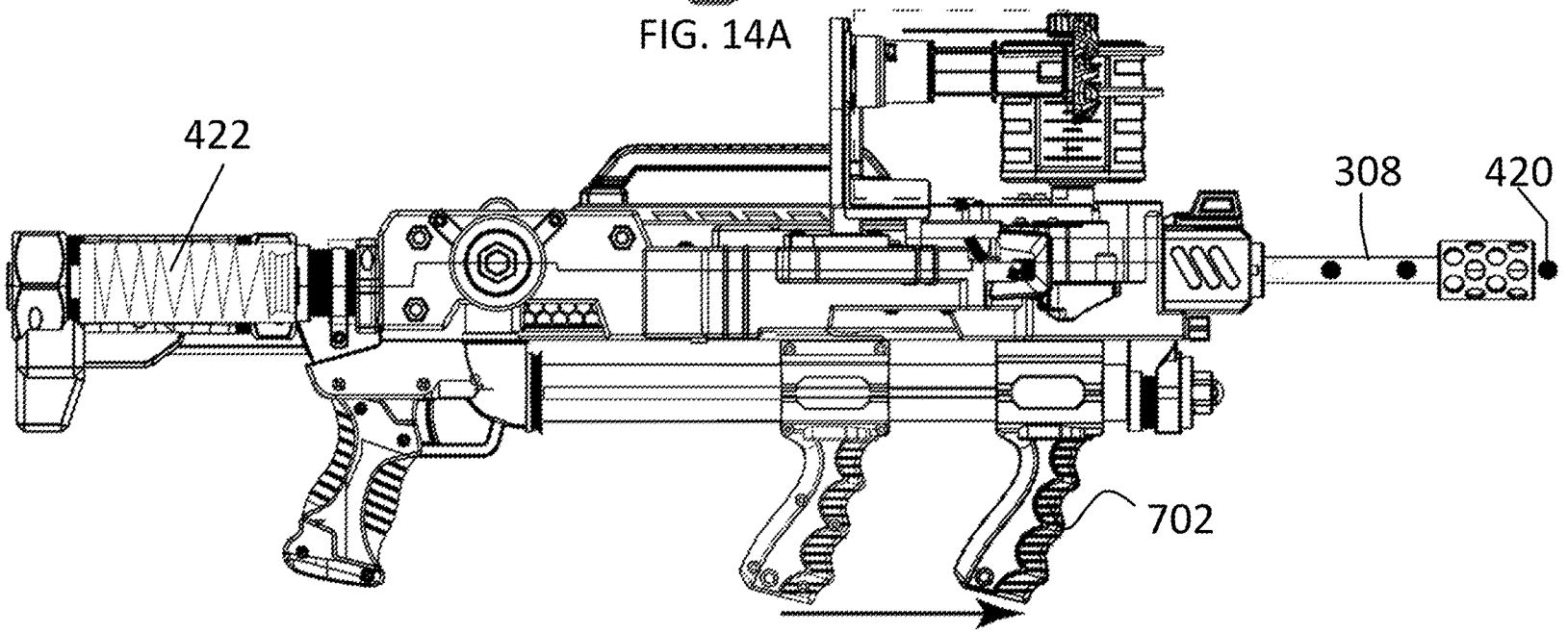
FIG. 14B is a side-view illustration of the spitball gun as depicted in FIG. 7.
Figure 15A:
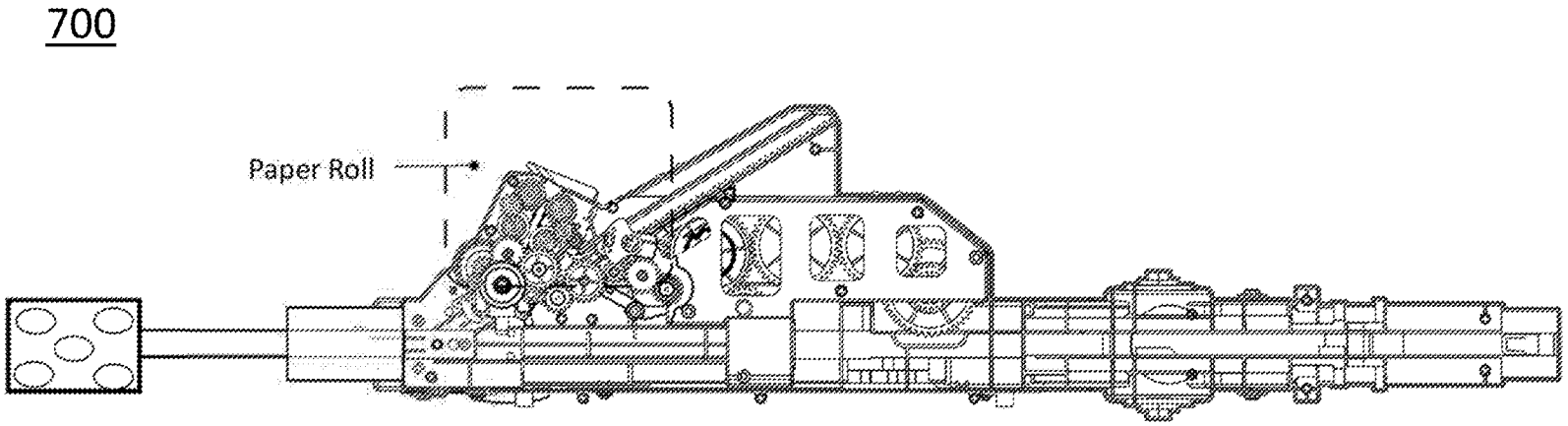
FIG. 15A is an interior, top-view illustration of the spitball gun as depicted in FIG. 7.
Figure 15B:
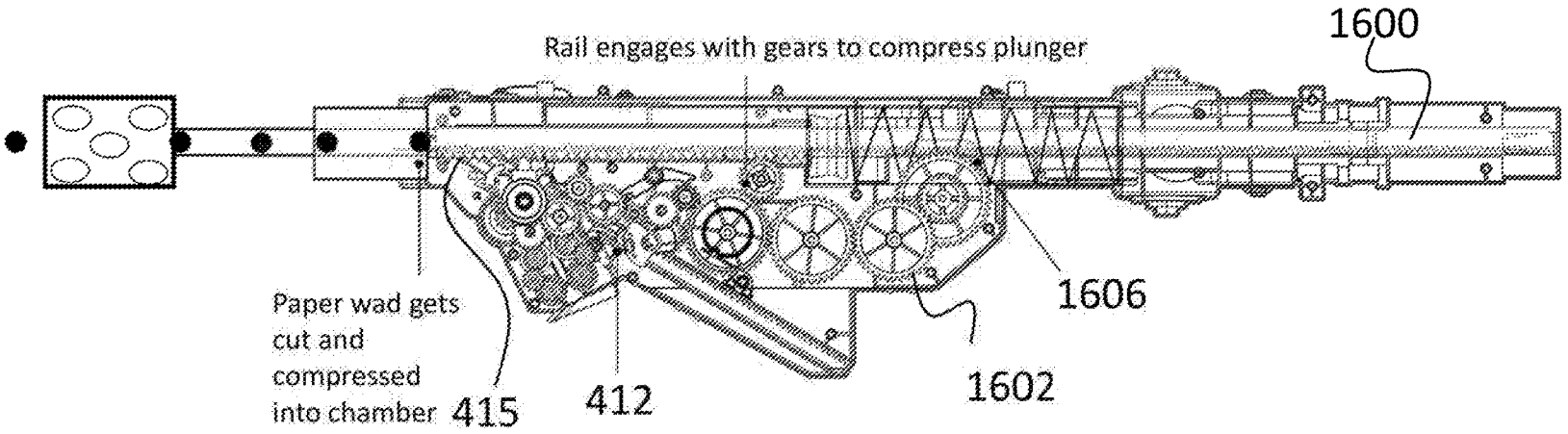
FIG. 15B is an interior, top-view illustration of the spitball gun as depicted in FIG. 7.
Figure 16:
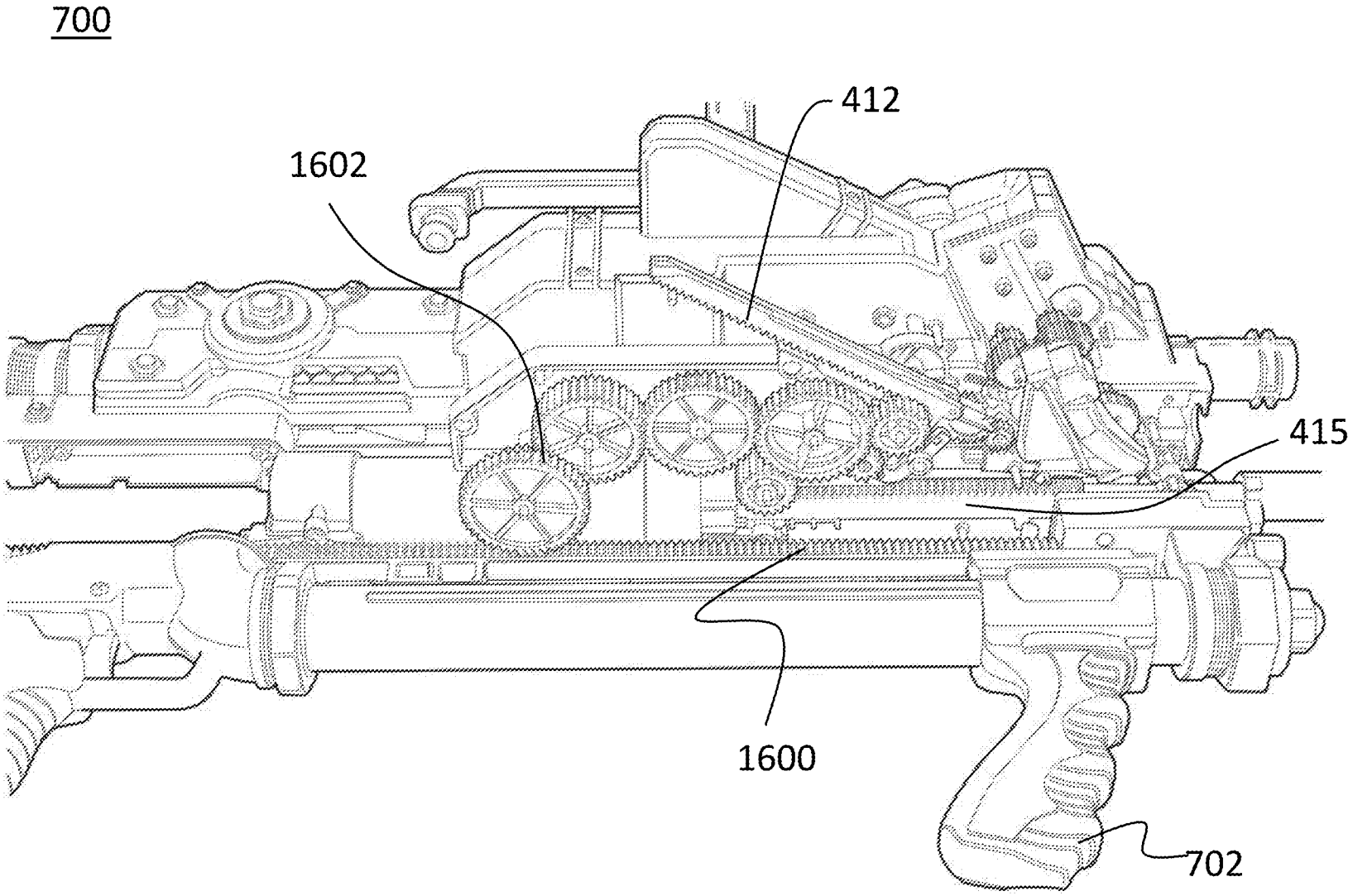
FIG. 16 is a bottom, interior-view illustration of the spitball gun as depicted in FIG. 7.
Figure 17:
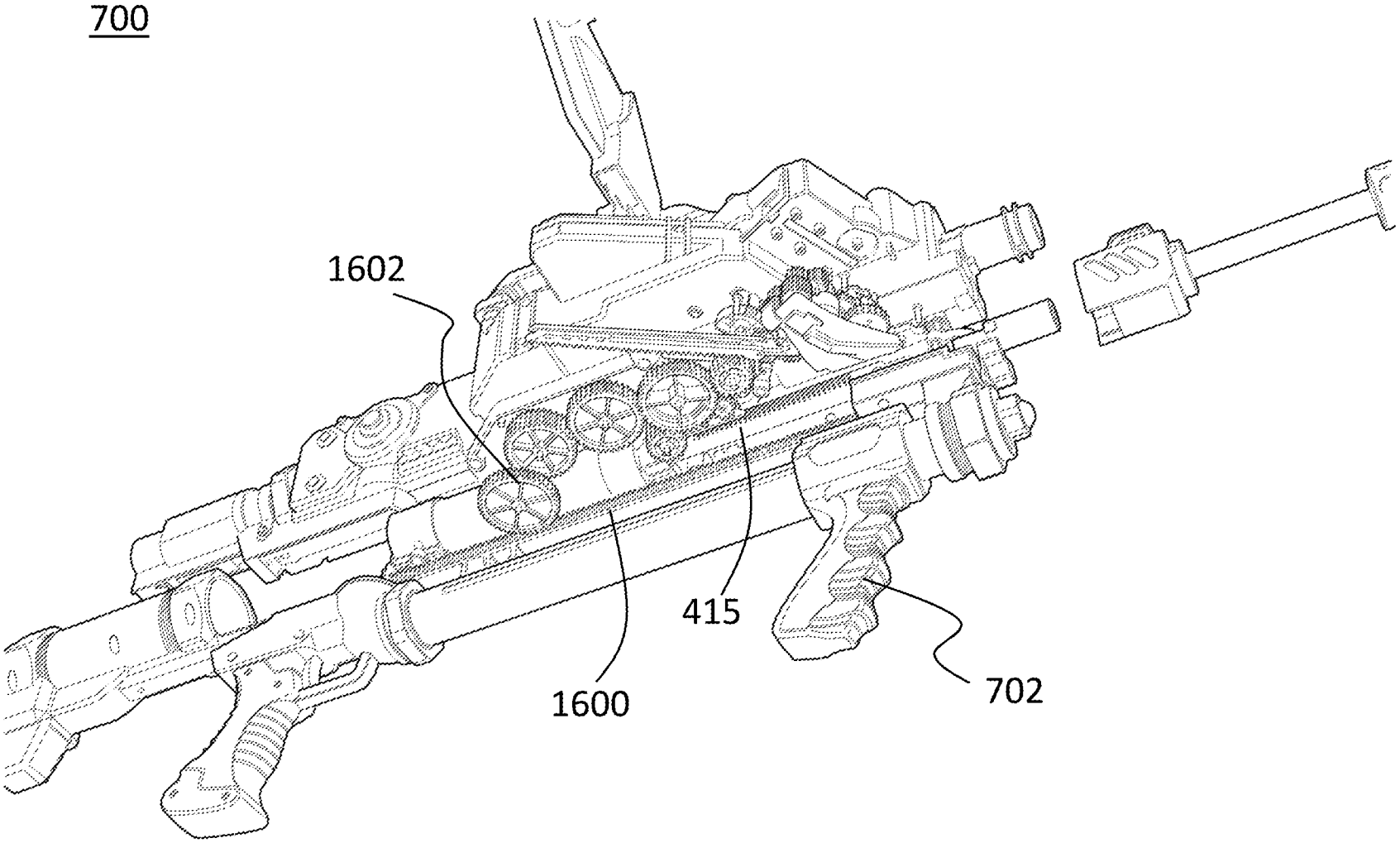
FIG. 17 is a bottom, interior-view illustration of the spitball gun as depicted in FIG. 7.

As shown in FIGS. 14A and 14B, pushing the sliding handle 702 forward causes the paper cutter 412 to withdraw from the paper wad and release the spring 422 to allow the air plunger to propel forward and force air from the barrel 308 and, in doing so, blast the paper wad 420 from the spitball gun 700. As was the case above, it should be noted that the spitball gun 700 can be used with any suitable paper or paper roll 402, such as toilet paper ammunition, paper towel ammunition, or any pulp or paper-like ammunition.

The spitball gun 700 can be formed in any suitable manner to allow a user to easily slide the sliding handle 702 to cause the elongated rod 415 to slide back and compress a spring 422 in the air tank 424. As noted above and as illustrated in FIGS. 15A through 17, this process can be operated by including of the sliding rod 1600 and gear train 1602 that operably connects with the elongated rod 415 and advancing mechanism. Teeth 1606 on the side of the sliding rod 1600 engage with the gear train 1602 (i.e., a plurality of gears) to pull back the elongated rod 415 as well as operate the advancing mechanism (via gearing) and paper cutter 412.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A spitball gun for use with paper ammunition, comprising:

a paper advancing chamber having an opening for receiving paper ammunition and an advancing mechanism for advancing paper through the paper advancing chamber;

a loading chamber for receiving paper from the paper advancing chamber;

an air tank fluidly connected with the loading chamber;

a barrel connected with the loading chamber, whereby paper loaded into the loading chamber is expelled from the barrel by air from the air tank;

a water tank fluidly connected with the loading chamber, the water tank having a water release mechanism; and a sliding handle operably connected with the advancing mechanism and the water release mechanism, such that sliding motion of the sliding handle causes paper to be pulled through the paper advancing mechanism while water is released onto the paper from the water tank.

2. The spitball gun as set forth in claim 1, further comprising a paper cutter housed within the spitball gun, the paper cutter positioned proximate the loading chamber to cut paper as loaded into the loading chamber.

3. The spitball gun as set forth in claim 2, further comprising:

a sliding rod attached with the sliding handle, the sliding rod having gear teeth;

a gear train operably connected with the gear teeth of the sliding rod and the advancing mechanism;

an elongated rod operably connected with the gear train, the elongated rod having a distal end operating as a loading plunger, such that sliding the sliding handle backwards cuts a piece of paper and, via the loading plunger, forces the paper into the loading chamber.

4. The spitball gun as set forth in claim 3, wherein the paper cutter is operably connected with the sliding handle such that motion of the sliding handle causes the paper cutter to slide into a cutting position.

5. The spitball gun as set forth in claim 4, wherein the elongated rod is spring loaded and further comprises a proximal end terminating with an air plunger.

6. The spitball gun as set forth in claim 1, further comprising:

a sliding rod attached with the sliding handle, the sliding rod having gear teeth;

a gear train operably connected with the gear teeth of the sliding rod and the advancing mechanism;

an elongated rod operably connected with the gear train, the elongated rod having a distal end operating as a loading plunger, such that sliding the sliding handle backwards cuts a piece of paper and, via the loading plunger, forces the paper into the loading chamber.

7. The spitball gun as set forth in claim 6, wherein the elongated rod is spring loaded and further comprises a proximal end terminating with an air plunger.

* * * * *